US007714282B2

(12) United States Patent
Guevremont et al.

(10) Patent No.: US 7,714,282 B2
(45) Date of Patent: May 11, 2010

(54) APPARATUS AND METHOD FOR FORMING A GAS COMPOSITION GRADIENT BETWEEN FAIMS ELECTRODES

(75) Inventors: Roger Guevremont, Ottawa (CA); Govindanunny Thekkadath, Ottawa (CA)

(73) Assignee: Thermo Finnigan LLC, San Jose, CA (US)

( * ) Notice: Subject to any disclaimer, the term of this patent is extended or adjusted under 35 U.S.C. 154(b) by 220 days.

(21) Appl. No.: 11/816,380

(22) PCT Filed: Feb. 17, 2006

(86) PCT No.: PCT/CA2006/000227

§ 371 (c)(1),
(2), (4) Date: May 19, 2008

(87) PCT Pub. No.: WO2006/086880

PCT Pub. Date: Aug. 24, 2006

(65) Prior Publication Data

US 2009/0108195 A1 Apr. 30, 2009

Related U.S. Application Data

(60) Provisional application No. 60/653,484, filed on Feb. 17, 2005.

(51) Int. Cl.

| | |
|---|---|
| ***H01J 49/42*** | (2006.01) |
| ***H01J 49/20*** | (2006.01) |
| ***H01J 49/22*** | (2006.01) |
| ***H01J 49/26*** | (2006.01) |

(52) U.S. Cl. ..... 250/290; 250/281; 250/282

(58) Field of Classification Search ..... 250/281, 250/282, 283, 287, 288, 289, 290, 291, 292, 250/293, 297

See application file for complete search history.

(56) References Cited

U.S. PATENT DOCUMENTS

| | | | | |
|---|---|---|---|---|
| 5,763,878 | A * | 6/1998 | Franzen | 250/292 |
| 2005/0269506 | A1* | 12/2005 | Kalinitchenko | 250/288 |
| 2006/0038121 | A1* | 2/2006 | Guevremont | 250/290 |

* cited by examiner

*Primary Examiner*—David A Vanore
*Assistant Examiner*—Nicole Ippolito Rausch
(74) *Attorney, Agent, or Firm*—Freedman & Associates; Charles B. Katz

(57) ABSTRACT

A method of separating ions includes providing a FAIMS analyzer region for separating ions, the FAIMS analyzer region in fluid communication with an ionization source and with an ion detecting device. The method further includes affecting a gas composition within a first portion of the FAIMS analyzer region to be different from a gas composition within a second portion of the FAIMS analyzer region. The establishment of a gas composition gradient within the FAIMS analyzer region enhances ion focusing and ion transport efficiency.

27 Claims, 14 Drawing Sheets

APPARATUS AND METHOD FOR FORMING A GAS COMPOSITION GRADIENT BETWEEN FAIMS ELECTRODES

CROSS-REFERENCE TO RELATED APPLICATIONS

This application is a National Stage application under 35 U.S.C. §371 of PCT Application No. PCT/CA2006/000227, filed 17 Feb. 2006, entitled "APPARATUS AND METHOD FOR FORMTNG A GAS COMPOSITION GRADIENT BETWEEN FAIMS ELECTRODES", which claims the priority benefit of U.S. Provisional Patent Application No. 60/653,484, filed 17 Feb. 2005, entitled "APPARATUS AND METHOD FOR FORMING A GAS COMPOSITION GRADIENT BETWEEN FAIMS ELECTRODES", which applications are incorporated herein by reference in their entireties.

This application claims benefit from U.S. Provisional application 60/653,484 filed Feb. 17, 2005, the entire contents of which are incorporated herein by reference.

FIELD OF THE INVENTION

The instant invention relates generally to High Field Asymmetric Waveform Ion Mobility Spectrometry (FAIMS). In particular, the instant invention relates to a method and apparatus for providing a gradient in the gas composition within the carrier gas in a FAIMS analyzer region.

BACKGROUND OF THE INVENTION

High sensitivity and amenability to miniaturization for field-portable applications have helped to make ion mobility spectrometry (IMS) an important technique for the detection of many compounds, including narcotics, explosives, and chemical warfare agents as described, for example, by G. Eiceman and Z. Karpas in their book entitled "Ion Mobility Spectrometry" (CRC, Boca Raton, 1994), the entire contents of which is incorporated herein by reference. In IMS, gas-phase ion mobilities are determined using a drift tube with a constant electric field. Ions are separated in the drift tube on the basis of differences in their drift velocities. At low electric field strength, for example 200 V/cm, the drift velocity of an ion is proportional to the applied electric field strength, and the mobility, K, which is determined from experimentation, is independent of the applied electric field. Additionally, in IMS the ions travel through a bath gas that is at sufficiently high pressure that the ions rapidly reach constant velocity when driven by the force of an electric field that is constant both in time and location. This is to be clearly distinguished from those techniques, most of which are related to mass spectrometry, in which the gas pressure is sufficiently low that, if under the influence of a constant electric field, the ions continue to accelerate.

E. A. Mason and E. W. McDaniel in their book entitled "Transport Properties of Ions in Gases" (Wiley, New York, 1988), the entire contents of which is incorporated herein by reference, teach that at high electric field strength, for instance fields stronger than approximately 5,000 V/cm, the ion drift velocity is no longer directly proportional to the applied electric field, and K is better represented by $K_H$, a non-constant high field mobility term. The dependence of $K_H$ on the applied electric field has been the basis for the development of high field asymmetric waveform ion mobility spectrometry (FAIMS). Ions are separated in FAIMS on the basis of a difference in the mobility of an ion at high field strength, $K_H$, relative to the mobility of the ion at low field strength, K. In other words, the ions are separated due to the compound dependent behavior of $K_H$ as a function of the applied electric field strength.

In general, a device for separating ions according to the FAIMS principle has an analyzer region that is defined by a space between first and second spaced-apart electrodes. The first electrode is maintained at a selected dc voltage, often at ground potential, while the second electrode has an asymmetric waveform V(t) applied to it. The asymmetric waveform V(t) is composed of a repeating pattern including a high voltage component, $V_H$, lasting for a short period of time $t_H$ and a lower voltage component, $V_L$, of opposite polarity, lasting a longer period of time $t_L$. The waveform is synthesized such that the integrated voltage-time product, and thus the field-time product, applied to the second electrode during each complete cycle of the waveform is zero, for instance $V_H t_H + V_L t_L = 0$; for example +2000 V for 10 μs followed by −1000 V for 20 μs. The peak voltage during the shorter, high voltage portion of the waveform is called the "dispersion voltage" or DV, which is identically referred to as the applied asymmetric waveform voltage.

Generally, the ions that are to be separated are entrained in a stream of gas flowing through the FAIMS analyzer region, for example between a pair of horizontally oriented, spaced-apart electrodes. Accordingly, the net motion of an ion within the analyzer region is the sum of a horizontal x-axis component due to the stream of gas and a transverse y-axis component due to the applied electric field. During the high voltage portion of the waveform, an ion moves with a y-axis velocity component given by $v_H = K_H E_H$, where $E_H$ is the applied field, and $K_H$ is the high field ion mobility under operating electric field, pressure and temperature conditions. The distance traveled by the ion during the high voltage portion of the waveform is given by $d_H = v_H t_H = K_H E_H t_H$, where $t_H$ is the time period of the applied high voltage. During the longer duration, opposite polarity, low voltage portion of the asymmetric waveform, the y-axis velocity component of the ion is $v_L = KE_L$, where K is the low field ion mobility under operating pressure and temperature conditions. The distance traveled is $d_L = v_L t_L = KE_L t_L$. Since the asymmetric waveform ensures that $(V_H t_H) + (V_L t_L) = 0$, the field-time products $E_H t_H$ and $E_L t_L$ are equal in magnitude. Thus, if $K_H$ and K are identical, $d_H$ and $d_L$ are equal, and the ion is returned to its original position along the y-axis during the negative cycle of the waveform. If at $E_H$ the mobility $K_H > K$, the ion experiences a net displacement from its original position relative to the y-axis. For example, if a positive ion travels farther during the positive portion of the waveform, for instance $d_H > d_L$, then the ion migrates away from the second electrode and eventually will be neutralized at the first electrode.

In order to reverse the transverse drift of the positive ion in the above example, a constant negative dc voltage is applied to the second electrode. The difference between the dc voltage that is applied to the first electrode and the dc voltage that is applied to the second electrode is called the "compensation voltage" (CV). The CV prevents the ion from migrating toward either the second or the first electrode. If ions derived from two compounds respond differently to the applied high strength electric fields, the ratio of $K_H$ to K may be different for each compound. Consequently, the magnitude of the CV that is necessary to prevent the drift of the ion toward either electrode is also different for each compound. Thus, when a mixture including several species of ions, each with a unique $K_H/K$ ratio, is being analyzed by FAIMS, only one species of ion is selectively transmitted to a detector for a given combination of CV and DV. In one type of FAIMS experiment, the applied CV is scanned with time, for instance the CV is slowly ramped or optionally the CV is stepped from one voltage to a next voltage, and a resulting intensity of transmitted ions is measured. In this way a CV spectrum showing the total ion current as a function of CV, is obtained.

Numerous ionization sources, including atmospheric pressure ionization sources, have been described for use with FAIMS. Some examples of ionization sources include MALDI, ESI, nanoelectrospray, picoelectrospray, APCI, laser desorption chemical ionization, photoionization, corona discharge, as non-limiting examples. In addition, detection of ions using several types of detectors, including mass spectrometry is known. Other examples of post-FAIMS ion processing tools include FAIMS, IMS, ion funnels, as some non-limiting examples. The above-mentioned ionization sources and detectors optionally are further assembled into various tandem arrangements, including ESI-FAIMS-funnel-IMS-funnel-MS, or ESI-FAIMS-FAIMS trap-IMS-funnel-MS, as two very complex but non-limiting examples of tandem instruments with practical importance in chemical analysis.

In an analytical instrument that includes (1) an atmospheric pressure ionization source, such as for example electrospray ionization (ESI), (2) an atmospheric pressure gas phase ion separator, such as for example high-field asymmetric waveform ion mobility spectrometer (FAIMS) and (3) a detection system, such as for example mass spectrometry, (MS) it is advantageous to provide each with independent control of some of the operating conditions including temperature, operating gas pressure, and operating gas composition. In these regards, the ion source, FAIMS and mass spectrometer have significantly different requirements for optimum performance.

The performance of FAIMS for separation of ions may be dependent on temperature. For example an elevation in temperature may cause peaks in a CV spectrum to widen because of an increase in ion diffusion. Under this condition two ions that are separated at room temperature fail to be separated at 100° C., for example. Similarly, two ions that fail to separate at room temperature are separated at 10° C. with cooled FAIMS electrodes, for example.

Furthermore, the efficiency of transmission of ions through FAIMS is a function of temperature. For example, some types of ions are subject to thermal dissociation and therefore are more efficiently transmitted through FAIMS in a cool bath gas.

Furthermore, the separation of ions is a function of the composition of the carrier gas. Some mixtures of gases, including nitrogen plus helium, and helium plus carbon dioxide, as some non-limiting examples, are known to significantly affect the compensation voltage of the transmission of some ions. These mixtures of gases optionally are controlled and selected to separate ions which otherwise are not separated in any one pure type of carrier gas. Prior U.S. Pat. No. 6,774,360 describes the method and apparatus for improvements in separation and sensitivity in FAIMS, and is included herein by reference. Related patent publications WO 03/067237 and WO 03/067242 describe detection of traces of gases in FAIMS using the shift of CV of a monitor ion, and also are included herein by reference. The CV of the monitor ion shifts because the presence of the trace gas changes the carrier gas composition and therefore changes the optimum conditions for the transmission of the monitor ion.

Furthermore, the separation of ions and the efficiency of ion transmission in the FAIMS analyzer are a function of many mechanical electrode dimensions and a function of many aspects of the voltages and experimental conditions used in FAIMS. For example, the resolution of the separation in FAIMS is a function of the diameters of the electrodes, the width of the analyzer region between the electrodes, the length of time that the ions reside within the analyzer region, the longitudinal location of the inner electrode (domed type electrodes), the frequency of the applied asymmetric waveform, the shape of the asymmetric waveform (square vs two or more superimposed sinusoidal waves), the peak voltage of the asymmetric waveform (DV), as some non-limiting examples. A skilled user of FAIMS adjusts these parameters, and others, to achieve separations.

Accordingly, it would be advantageous to provide control of a number of non-mechanical experimental parameters that impact on the separation of ions, including the temperature of one or both FAIMS electrodes, the pressure of the carrier gas in the FAIMS analyzer, the temperature gradient across the analyzer region of FAIMS, and the composition of the gas mixture used as the carrier gas in the FAIMS analyzer, as some non-limiting examples. These parameters optionally are adjusted independently, or in conjunction with each other, to achieve the performance that is desired.

A method and apparatus for control of the temperature of the ionization source of FAIMS has been described in U.S. Pat. No. 5,736,739 and is incorporated herein by reference. The methods and apparatus for independent control of temperatures and pressures of the ion sources and FAIMS systems was first introduced in previously filed U.S. provisional applications 60/536,707 and 60/572,116 which are incorporated by reference herein. In these filings it was shown to be advantageous to design cylindrical FAIMS and parallel plate FAIMS with independent control of temperatures of the two electrodes to permit adjustment of the two electrodes to be at different temperatures, and at temperatures that differ from the average temperature of the carrier gas. Appropriate selection of these temperatures produces temperature gradients in the gas across the analyzer region, to beneficially influence the ion transmission efficiency and the separation of ions during their passage through the analyzer region.

Certain mixtures of carrier gases are known to significantly impact on the performance of FAIMS. Examples of reports in the scientific literature describing this impact include a paper by Barnett, D. A.; Purves, R. W.; Ells, B. Guevremont, R., entitled "*Separation of ortho-, meta-, and para-phthalic acids by high-field asymmetric wavefrom ion mobility spectrometry using mixed carrier gases*," in J. Mass Spectrom. 2000, 35, 976-980 and a paper authored by Shvartsburg, A.; Tang, K.; Smith, R. D., entitled "*Understanding and designing field asymmetric waveform ion mobility separations in gas mixtures*," in Analytical Chemistry 2004, 76, 7366-7374, the entire contents of both of which are incorporated herein by reference. For example, additions of carbon dioxide (1% to 20% by volume) to a carrier gas of nitrogen increases the CV of transmission and the efficiency of transmission for many low-mass ions, as a non-limiting example.

SUMMARY OF THE INVENTION

It is an object of at least one of the embodiments of the instant invention to affect ion transmission and ion separation by forming gradients in the composition of the mixture of gas that serves as the carrier gas.

It is a further object of at least one of the embodiments of the instant invention to deliver two or more gases together in a laminar flow between the FAIMS electrodes, to minimize turbulence and mechanical mixing of the gases.

According to an aspect of the instant invention there is provided an apparatus for separating ions, comprising: a first electrode and a second electrode disposed one relative to the other in a spaced-apart facing arrangement for defining an analyzer region therebetween, the analyzer region including a first end and a second end and having a length extending between the first end and the second end; a first gas inlet in fluid communication with the analyzer region, for providing a flow of a carrier gas of a first composition; a second gas inlet in fluid communication with the analyzer region, for providing a flow of a carrier gas of a second composition; and, a gas-flow directing element in fluid communication with the first gas inlet and in fluid communication with the second gas inlet, for receiving the flow of the carrier gas of the first composition and the flow of the carrier gas of the second composition, and for providing within a portion of the analyzer region a carrier gas flow having a composition that is non-uniform in space.

According to an aspect of the instant invention, provided is a method of separating ions, comprising: providing a high field asymmetric waveform ion mobility spectrometry (FAIMS) analyzer region for separating ions; providing a flow of a carrier gas within a portion of the FAIMS analyzer region, the flow of carrier gas having a composition that is non-uniform in space along a direction transverse to the flow of the carrier gas; introducing ions into the FAIMS analyzer region; providing electric field conditions within the FAIMS analyzer region for selectively transmitting a subset of the ions through the FAIMS analyzer region; and, selectively transmitting the subset of ions along an average ion flow path through the FAIMS analyzer region.

According to an aspect of the instant invention, provided is a method of separating ions, comprising: providing a high field asymmetric waveform ion mobility spectrometry (FAIMS) analyzer region for separating ions, the FAIMS analyzer region comprising an ion origin end that is in fluid communication with an ionization source, and an ion exit end that is in fluid communication with an ion detecting device, a length of the FAIMS analyzer region defined along a direction between the ion origin end and the ion detection end; providing a flow of a first gas into a gas inlet region of the FAIMS analyzer region; and, providing separately a flow of a second gas into the gas inlet region of the FAIMS analyzer region, and absent forming a homogeneous carrier gas flow including the first gas and the second gas within the gas inlet region.

BRIEF DESCRIPTION OF THE DRAWINGS

Exemplary embodiments of the invention will now be described in conjunction with the following drawings, in which similar reference numerals designate similar items.

DESCRIPTION OF THE PREFERRED EMBODIMENTS

Figure 1:
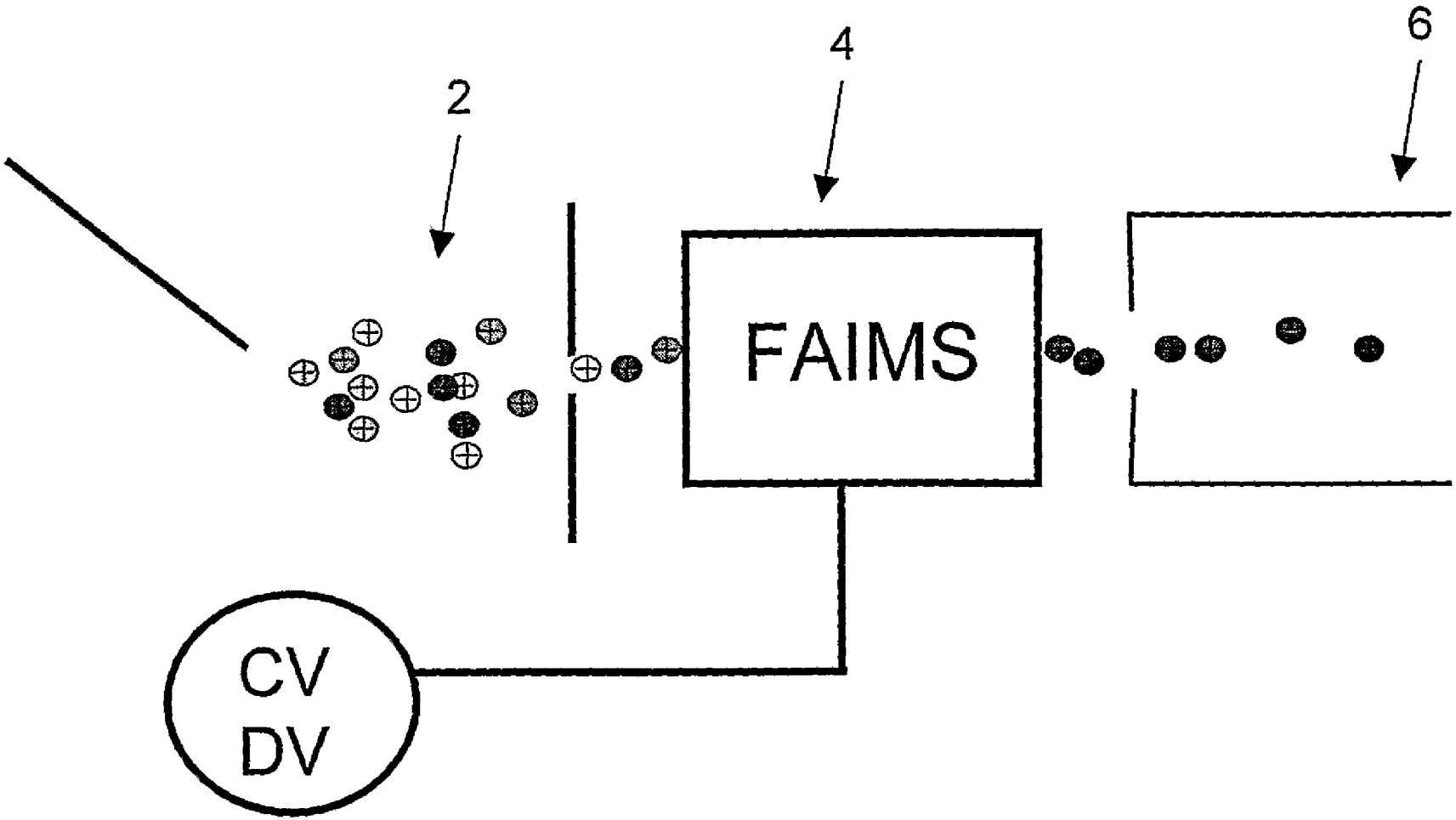
FIG. 1 is a simplified block diagram of a chemical analysis system showing a tandem arrangement including an ion source, a FAIMS, and a mass spectrometer.

The following description is presented to enable a person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and the scope of the invention. Thus, the present invention is not intended to be limited to the embodiments disclosed, but is to be accorded the widest scope consistent with the principles and features disclosed herein.

Throughout much of the following discussion it is assumed that the FAIMS electrodes operate at atmospheric pressure, but operating at pressures below and at pressures exceeding ambient atmospheric pressure conditions also are envisaged.

Because ion separation and ion transmission in a FAIMS system is susceptible to changes in temperature, it is desirable to operate at a selected temperature. For example, a rise in temperature leads to a decrease in the number density of the gas (N, molecules per cc) and therefore the operating electric field (E/N) increases. Similarly an increase in gas pressure increases N and therefore decrease the effective E/N conditions. In order that experiments give consistent results when repeated, the temperatures and pressures preferably are maintained at selected values within known tolerance limits.

It is also beneficial that the physical conditions in the analyzer region of FAIMS do not significantly change the CV of the transmission of the ion of interest while it is passing through the analyzer region, to a degree that prevents the transmission of the ion of interest. For example, if the conditions differ substantially as the ions are carried through FAIMS, those ions that are initially being successfully transmitted near the ion inlet region may be lost to the electrode walls at a later time during their passage through the FAIMS analyzer region. This occurs if the conditions near the inlet are in a balanced condition for the selected ion, and the ion is being transmitted near the inlet, but at a location elsewhere in the analyzer region the conditions are sufficiently different that the same ion migrates to the electrode walls and is neutralized. Temperature, pressure and spacing between the electrodes are among the physical conditions, assuming constant applied voltages, affecting the CV of transmission of an ion. For example, a substantial difference in the electrode spacing near the ion inlet and near the ion outlet results in the field E/N near the inlet and near the outlets being different from each other. Moderate changes are beneficial to improve ion separation in certain instances, but larger changes that the ion experiences for longer periods of time result in complete loss of ion transmission. Additionally, the physical conditions may be beneficially varied in specific locations within the FAIMS analyzer region, for example the field E/N is stronger near the inner electrode than near the outer electrode. Such local variations are beneficial so long as the overall conditions are not sufficiently changed so as to result in complete loss of the ions. The magnitudes of the total changes in physical conditions, and of the local changes in physical conditions, are established by experimental measurements, and the conditions adjusted to achieve the ion transmission sensitivity and the ion separation required.

In cylindrical and spherical geometry FAIMS it is known that an ion focusing mechanism is a result of the gradient of E/N that forms between the inner and outer electrode. The ion focusing causes the ion cloud to be constrained in the vicinity of an optimal, radial location between the electrodes, and therefore assists in minimization of ion loss to the electrode walls. In FAIMS having electrode geometry in which the electric field strength (E/N) changes across the analyzer region between electrodes, this gradient of E/N is responsible for the focusing mechanism. Electrodes with cylindrical and spherical geometry are some non-limiting examples wherein the field, E/N, changes strength along the radial direction between the FAIMS electrodes. At appropriate conditions of applied waveform and compensation voltage, as well as pressure, temperature, gas composition etc. as some non-limiting examples, the ion cloud is focused in the analyzer region, an effect that is beneficial by minimization of ion loss via collision with the electrode walls. The value of E/N is modified by voltages applied to the electrodes, and by the temperature and the pressure of the gas between the electrodes. Moreover, a gradient of E/N is formed when gradients of the temperature and the pressure of the gas are formed. For example a gradient of E/N is produced when a voltage difference is applied between two electrodes across a region where the gas adjacent to a first electrode is at higher temperature than the region adjacent to the second electrode, and where the temperature in the gas between the electrodes varies gradually between these two temperatures. In this example the value of N, which is the number density of the gas, varies with temperature and thereby changing the value of E/N as a function of the temperature. The gradients of E/N induced by temperature gradients in the gas between FAIMS electrodes are optionally used to beneficially modify the focusing properties of both cylindrical and parallel plate versions of FAIMS.

The parallel plate version of FAIMS is known to lack any focusing properties, away from the edges of the plates, in the absence of temperature gradients between the electrodes. A beneficial focusing occurs when temperature conditions between the electrodes serve to mimic the E/N gradient found in cylindrical geometry FAIMS. The transmission of ions at a fixed CV requires control of the temperature of the gas and the electrodes, such that the CV conditions for transmission of a selected ion do not change excessively during the time it takes for an ion to pass between the electrodes It is beneficial that the CV of transmission is constant throughout the device, while simultaneously affecting the temperature of the gas between the electrodes to create conditions for focusing of the ion cloud. In a second approach the value of N is changed by causing the pressure to change in regions between the electrodes, for example using an acoustic transducer as a non-limiting example. Other means of modifying N in the space between the electrodes using lasers, for example, are envisioned.

FIG. 1 is a simplified block diagram of a chemical analyzer showing a tandem arrangement including an ion source 2, a FAIMS 4, and a detection system 6. In the specific and non-limiting example of FIG. 1, an electrospray ionizer is shown. However, many other suitable ion sources are known, including nano-electrospray, pico-electrospray systems, photoionization sources, atmospheric pressure MALDI, radioactivity based sources, corona discharge sources, and other rf-based capacitive and/or inductively coupled discharge sources, as a few non-limiting examples. Depending on the mechanism and design of the ionizer, the ionizer operates on samples presented as gases, streams of liquids, liquids on solid support, or solids, to name a few non-limiting examples. The components 2, 4, and 6 that are shown at FIG. 1 are all at room temperature, but it is advantageous to set operational variables, including temperature, pressure, gas composition etc. to values that are best suited for the analysis in which the chemical analyzer is operating. In addition, the chemical analyzer is optionally operated in conjunction with other sample preparation and separation systems including autosamplers, robotic sample handling systems, gas chromatographs, liquid chromatographs, and capillary electrophoresis, as some non-limiting examples. In summary, since FAIMS is integrated into the chemical analysis system between the ionization source and the detection system, all other peripheral systems that are commonly used in a chemical analysis system continue to be operative. The FAIMS generally does not limit the scope of other peripheral instruments, nor the type of chemical analysis that can be performed by the generalized chemical analysis system shown in FIG. 1. The detection system 6 optionally is one of an electrometric ion current sensor, a mass spectrometer, an optical sensor, and an ion processing device including further FAIMS, ion-trapping FAIMS, IMS, ion funnels as some non-limiting examples. The detection system 6 optionally is a tandem arrangement of these devices, for example trapping FAIMS-funnel-IMS-funnel-MS, as a non-limiting example.

Figure 2:
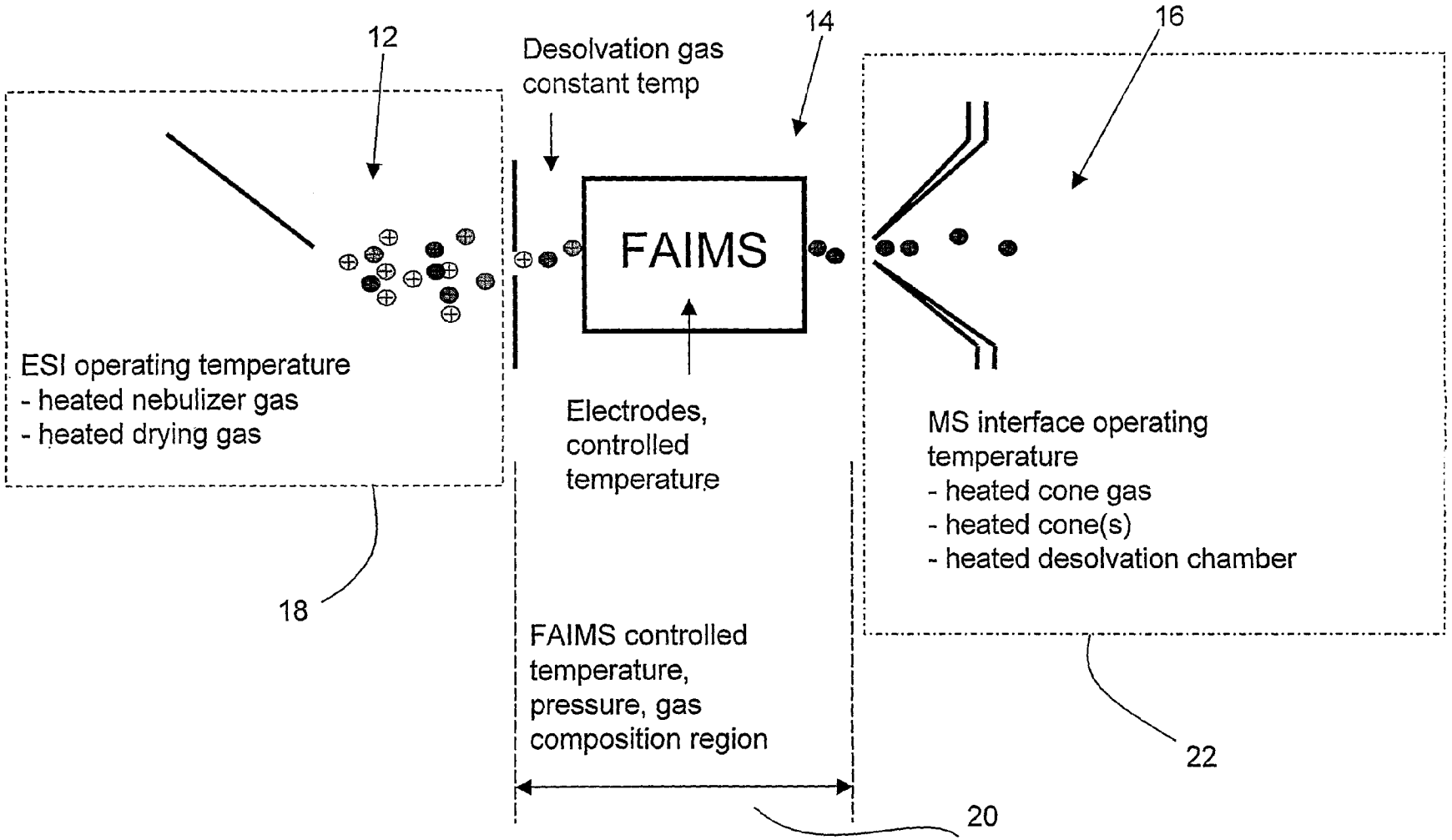
FIG. 2 is a simplified block diagram of a chemical analysis system comprising a tandem arrangement including an ion source, a FAIMS, and a mass spectrometer, supporting independent temperature, pressure, and gas composition control of a source region, a FAIMS region, and a mass spectrometer region.

FIG. 2 is a simplified block diagram showing a tandem arrangement including an ion source 12, a FAIMS 14, and a mass spectrometer 16, supporting independent temperature, pressure and gas composition control of a source region 18, a FAIMS region 20, and a mass spectrometer region 22. While the control of gas composition is emphasized throughout this document, it is to be understood that operation at gas pressures higher than and lower than atmospheric pressure is also envisaged and operation at temperatures above and below room temperature is also envisaged. For example the ion source 12 operates optionally at twice atmospheric pressure provided that an appropriate chamber (not shown) surrounds the source region 18, and FAIMS 14 operates optionally at 0.3 of an atmosphere provided that an appropriate chamber (not shown) surrounds the FAIMS region 20 and appropriate apertures (not shown) separate the source region 18 and the FAIMS region 20. Of course, any mention of specific operating pressures and/or temperatures is given by way of non-limiting example only.

Figure 3:
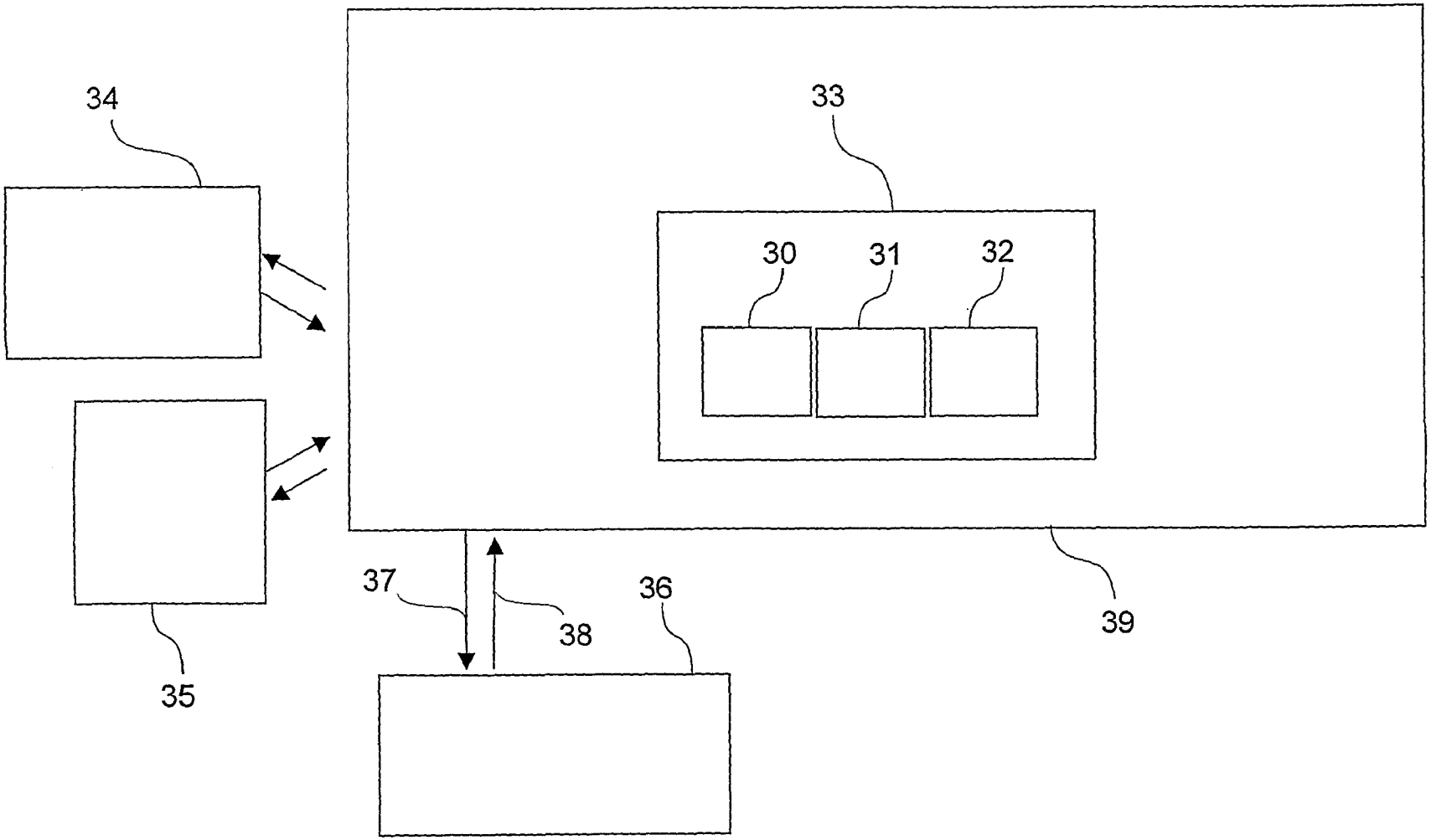
FIG. 3 is a simplified block diagram of a chemical analysis system comprising a tandem arrangement including an ion source, a FAIMS, and a mass spectrometer, further incorporated into a drug discovery and drug production environment.

Referring now to FIG. 3, shown is a chemical analysis system 33 that includes sub-systems comprising chemical sample processor 30, ionization system 31, and an ion analyzer 32. Ion analyzer 32 optionally comprises one or more sub-systems, individually or in tandem arrangement, including FAIMS, drift tube ion mobility spectrometry, mass spectrometry, etc. As a first non-limiting example, the ion analyzer 32 comprises a tandem arrangement of FAIMS and a mass spectrometer similar to the system shown in FIG. 2. As a second non-limiting example, the ion analyzer 32 comprises a tandem arrangement of FAIMS coupled to a drift tube mobility analyzer coupled in turn to a time-of-flight mass spectrometer.

Still referring to FIG. 3, the chemical analysis system 33 is situated in a central chemical laboratory 39. Arrows 37 and 38, and other arrows not enumerated, represent the exchange of samples and data between subdivisions 34, 35 and 36 of the organization that utilizes the services of the chemical analysis laboratory 39. Some non-limiting examples of the subdivisions are shown in FIG. 3. For instance, a first subdivision 34 is responsible to ensure quality control in a pharmaceutical production factory. A second subdivision 35 is engaged in drug discovery, and provides samples related to drug interactions with chemical entities in living organisms, the chemical entities including enzymes, proteins, DNA, RNA, cell walls, sub-cellular entities including mitochondria, as some non-limiting examples. A third subdivision 36 is engaged in pharmico-kinetics and provides samples indicative of the efficacy of drug products and the formation of secondary chemical species resulting from drug metabolism. This diagram is intended to be a non-limiting example of the wide applicability of chemical analysis technology within organizations. Those applications that were previously operative using chemical tools including LC, ESI, MALDI, and mass spectrometry may be significantly improved by including FAIMS with the gas composition gradient as described herein.

Figure 4:
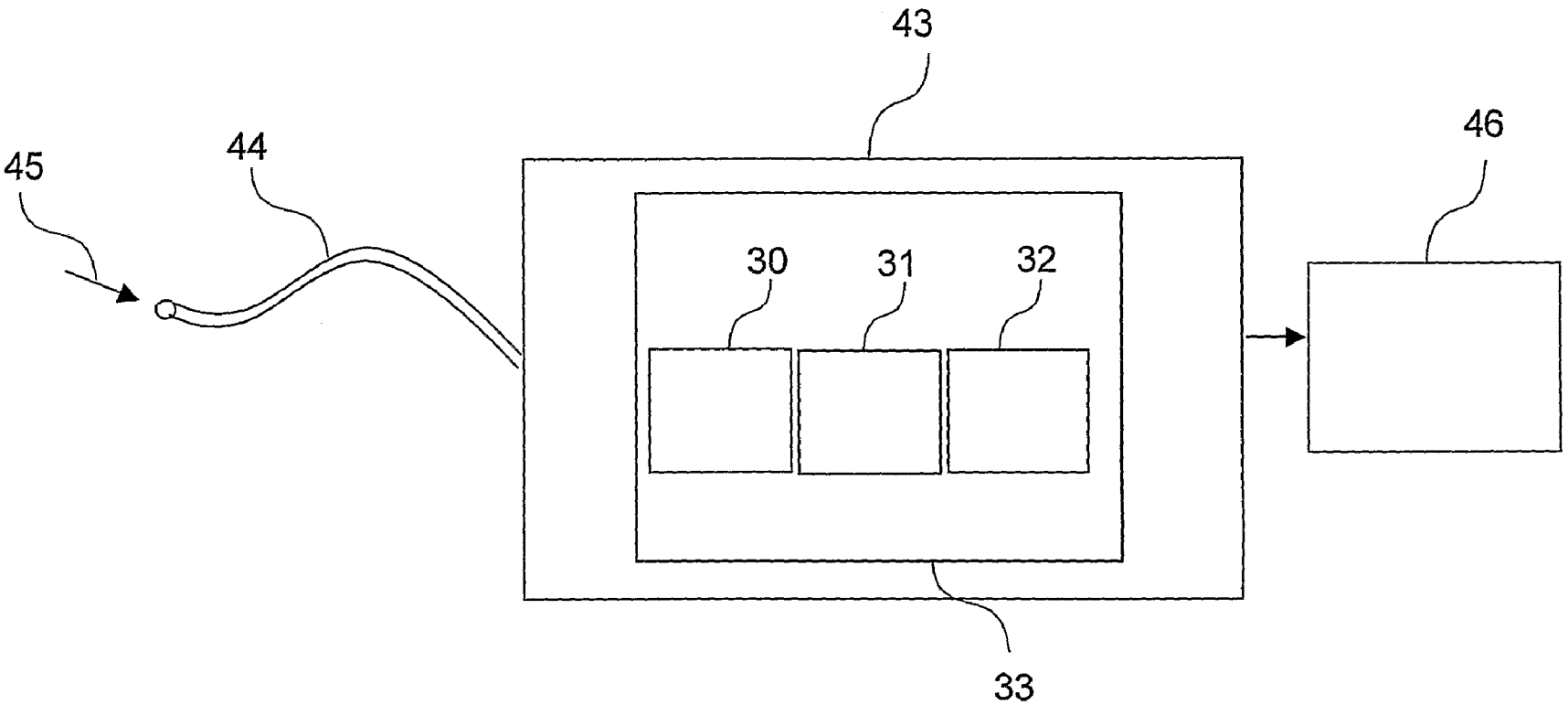
FIG. 4 is a simplified block diagram of a chemical analyzer comprising a tandem arrangement including an ion source, a FAIMS, and a mass spectrometer, further incorporated within a sampling system to provide detection of chemicals.

FIG. 4 illustrates a chemical analysis system that is suitable for monitoring chemicals in locations other than an analytical chemistry laboratory. A mobile chemical analyzer 43 is provided with a sample flow 45 into a sample inlet conduit 44. The sample is delivered to the chemical analysis system 33. The chemical analysis system 33 includes sub-systems that may include a chemical sample processor 30, ionization system 31, and an ion analyzer 32. The ion analyzer 32 optionally includes one or more further sub-systems including a FAIMS analyzer, a drift tube ion mobility spectrometer, or a mass spectrometer. The subsystems are assembled in one of a plurality of different ways, depending upon specific requirements. In a first non-limiting example, the ion analyzer 32 comprises a tandem arrangement of FAIMS and a mass spectrometer similar to the system shown in FIG. 1 and FIG. 2. As a second non-limiting example, the ion analyzer 32 comprises a tandem arrangement of FAIMS coupled to a drift tube mobility analyzer coupled in turn to a time-of-flight mass spectrometer.

Still referring to FIG. 4, the chemical analyzer 43 is designed to detect chemical substances provided through sample flow 45. The sample flow optionally is one of a gas, liquid, or a solid, or a combination including solid particles suspended in a flow of gas, or liquid droplets suspended in a gas, or solid particles suspended in a liquid, as some non-limiting examples. The chemical analyzer 43 detects the presence one or more targeted compounds to indicate the presence of one or more substances including explosives, narcotics, contraband materials, biological substances including bacteria or spores or virus, chemical poisons, biological poisons, bio-terror or chemical weapons, as some non-limiting examples, and provides information to a communication system 46, such as for instance a human interface including an alarm or computer network to further transmit information, as some non-limiting examples.

Figure 5:
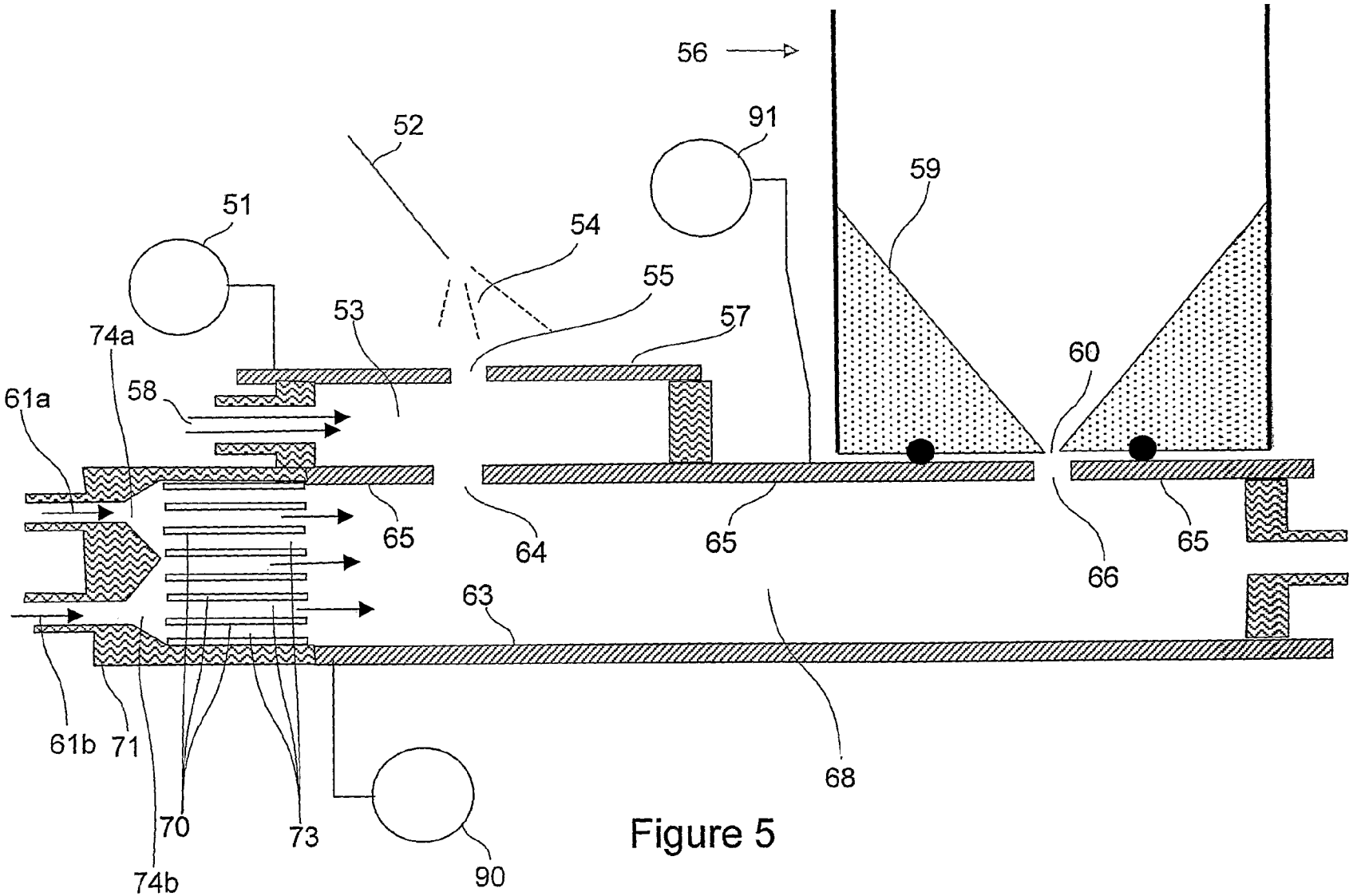
FIG. 5 is a parallel plate FAIMS provided with two gases of differing composition.

FIG. 5 illustrates one possible version of a flat plate geometry of FAIMS that is operated in a tandem arrangement with an electrospray ionization source and a mass spectrometer, for ion mass analysis and detection. The flat plate geometry of FAIMS includes an upper electrode 65 and a lower electrode 63, which define an analyzer region 68 therebetween. In this example, ions are formed from a flow of liquid sample in an ionization region 54 adjacent to an electrospray needle 52 that is held at high potential relative to a curtain plate 57. Some of the ions thus formed pass through the curtain plate aperture 55 against a counter-flow of curtain gas 58 supplied to the region 53 between the curtain plate 57 and the upper FAIMS electrode 65. The region 53 between the curtain plate 57 and the upper FAIMS electrode 65 is enclosed by insulating material so that the curtain gas 58 exits only through the curtain plate aperture 55 and/or through the ion inlet 64 to the FAIMS analyzer region 68. Power supply 51 is provided for applying a voltage on curtain plate 57, so as to establish a voltage difference between curtain plate 57 and upper FAIMS electrode 65 for directing ions toward ion inlet 64. Optionally, the gas flow though ion inlet 64 is low, and ions pass through the ion inlet 64 into a first end of analyzer region 68 under the influence of the electric fields formed by the voltage difference between the curtain plate 57 and the upper FAIMS electrode 65. Further optionally, a portion of curtain gas flow 58 passes through the ion inlet 64 and helps carry ions into the first end of analyzer region 68 where the flow of gas through ion inlet 64 combines with the flow 61*a* and 61*b* to transport the ions to the ion outlet 66.

Still referring to FIG. 5, the ions that enter the analyzer region 68 through ion inlet 64 are carried along the analyzer region by a flow of gas 61*a* and 61*b*, where the composition of gas flow 61 a optionally differs from the composition of gas flow 61*b*. During transport along the analyzer region 68 the ions are separated according to the FAIMS mechanism. The high voltage rf frequency asymmetric waveform is applied to lower electrode 63 from power supply 90. The voltage on upper electrode 65 is provided by power supply 91. The voltages and width of the analyzer region 68, as well as other operational variables including gas composition, gas pressure, gas temperature, gradient in temperature of the gas across the analyzer region 68, are selected to permit a subset of the ions provided from the ionization source to be transmitted to the ion outlet 66, and subsequently to an ion detection system 56, such as for instance a mass spectrometer ion inlet system as a non-limiting example.

Still referring to FIG. 5, a gas-flow directing element is provided in the form of a plurality of plate structures 70. Each plate structure of the plurality of plate structures is a flat plate including a first major surface and a second major surface along opposite sites thereof, for instance upper and lower plate surfaces, respectively, in FIG. 5. Each plate structure further includes a first edge surface and a second edge surface along opposite ends thereof, for instance left and right edge surfaces in FIG. 5. The plurality of plate structures 70 is disposed in a stacked, spaced-apart arrangement such that the first major surface of each plate structure faces the second major surface of an adjacent plate structure. The plurality of plate structures 70 is supported by electrically insulating material 71, so as to form a stack extending between the upper electrode 65 and the lower electrode 63. Accordingly, the plurality of plate structures defines a plurality of generally uniform gas-passage spaces 73 in an alternating arrangement with the plurality of plate structures. Each gas-passage space has a height along a stacking direction that is small relative to a length along a gas-flow direction. As shown in FIG. 5, the first edge surfaces of some of the plate structures is juxtaposed with a first gas inlet 74*a*, and the first edge surfaces of other of the plate structures is juxtaposed with a second gas inlet 74*b*. The plurality of plate structures 70 helps to form the gas flow 61*a* into a low-turbulence laminar flow that smoothly flows adjacent to upper electrode 65. The stack of plates 70 also helps to form the gas flow 61*b* into a comparable laminar flow adjacent to lower electrode 63. Optionally, the gas flow 61*a* differs in composition from that of the gas flow 61*b*. Since the two streams of gas diffuse into each other, and mix at the interface between the flows, a gradient of gas composition is formed, where the composition of the gas is similar to that of the gas flow 61*a* near upper electrode 65, and similar to the gas flow 61*b* near the lower electrode 63, but forms intermediate mixtures in the region midway between the upper electrode 65 and the lower electrode 63. The stream of ions that is carried from the ion inlet 64 to the ion outlet 66 is selectively located in a region of the gas composition gradient that has a gas composition suitable for focusing of the ions in dependence on operating conditions of voltage (DV and CV), temperature, pressure, analyzer gap width, as some non-limiting examples. The gas composition gradient provides a new tool for improving the efficiency of ion transmission, by providing a region towards which ions preferentially migrate, and therefore minimizing their collisions with the electrodes.

Figure 6:
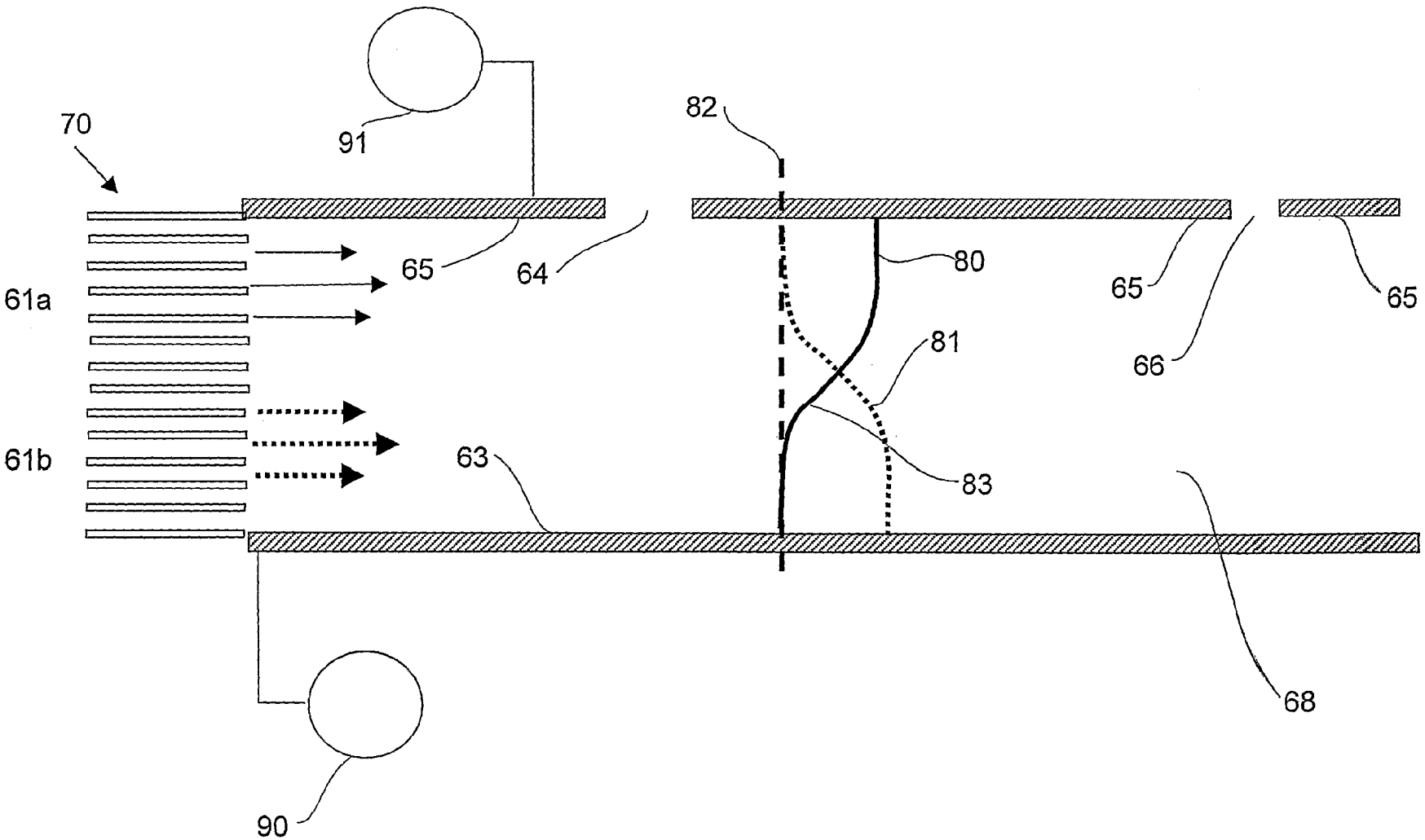
FIG. 6 illustrates the gradient of the composition of the gas between FAIMS electrodes.

FIG. 6 is an expanded view of a portion of FIG. 5, illustrating the region of the FAIMS analyzer 68 between upper electrode 65 and lower electrode 63. The stack of plate structures 70 serves to smooth the flows of gas flow 61*a* and gas flow 61*b* to travel parallel to the electrodes, with minimum turbulence or vortex motions. Curve 83 illustrates the percentage of gas flow 61*a* that contributes to the composition of the gas across the analyzer region 68. Dashed line 82 represents the zero composition limit. For example, at region 80 the gas composition is largely similar to gas flow 61*a*. The curve 83 approaches the dashed line 82 near the lower electrode 63 and indicates that the composition of the gas near the lower electrode 63 has very small contribution from the gas flow 61*a*. Similarly, dotted line 81 indicating percentage contribution from gas flow 61*b*, reaches a maximum near the lower electrode 63 and approaches the dashed line 82 near the upper electrode 65. The curves 83 and 81 are hand-drawn approximations to the changes in composition to be used for illustrative purposes, whereas the actual composition gradient may be more abrupt, or more gradual than these curve indicate.

Figure 7:
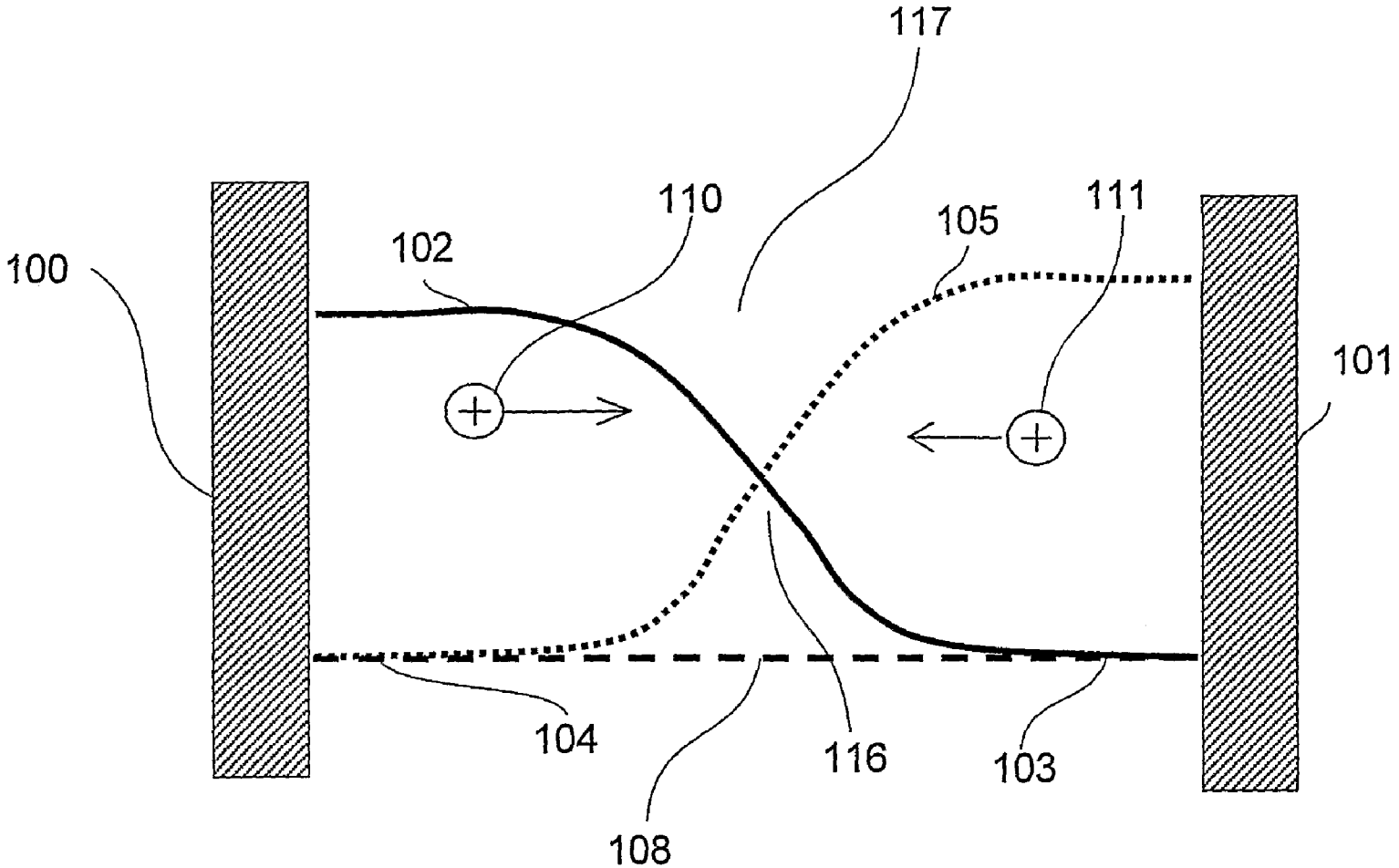
FIG. 7 illustrates the motion of ions in two regions of differing gas composition between FAIMS electrodes.

FIG. 7 illustrates the analyzer region 117 between a first FAIMS electrode 100 and a second FAIMS electrode 101. A first curve 102 represents the percentage of a first gas forming a gradient of composition in the gas across the analyzer region 117. A second curve 105 represents the percentage of a second gas forming a gradient of composition in the gas across the analyzer region 117. The dashed line 108 indicates zero contribution of the gas to the mixture. Near the first electrode 100 the curve 102 is at a maximum value indicating a high percentage of the mixture is composed of this first gas. The curve 102 is near the dashed line 108 adjacent the second electrode 101, and therefore is at lower percentage contribution to the mixture adjacent the second electrode 101. An asymmetric waveform (peak voltage DV) and a dc compensation voltage (CV) are applied to the electrodes, in the usual fashion for separation of ions in the FAIMS mechanism. For purposes of discussion, it is assumed that a first ion 110 has high field mobility properties in the gas near the first electrode 100, such that the ion drifts away from the first electrode 100 in a direction towards the second electrode 101. If the gas composition at all locations in the analyzer region is constant, in the same composition as the gas composition near electrode 100, the ion is expected to drift completely across the analyzer region 117 and collide with the second electrode 101, assuming flat parallel plate electrode-geometry in this example. By selection of a second gas with a differing composition, wherein the percentage composition of the second gas is indicated by curve 105, a second ion 111 of the same type located near the second electrode 101 drifts away from electrode 101 in a direction towards electrode 100. Since, under the same electric field, temperature, gas pressure, conditions the ion near the first electrode 100 drifts towards the middle of the analyzer region 117, and the same type of ion located near the second electrode 101 also drifts towards the middle of the analyzer region 117, this type of ion accumulates and is focused away from the electrodes. This focusing mechanism minimizes collision of this type of ion with the electrodes, and permits higher transmission efficiency of this ion through the FAIMS device. Moreover, other types of ions, which do not have the appropriate behavior of ion mobility at high field relative to low field as does the ion shown in FIG. 7, are expected to be lost through collision with the electrodes. Ions with mobility properties very similar to the ion shown in FIG. 7 may also be focused in these conditions, but may focus at slightly differing distance from one or the other electrode than the ion shown in FIG. 7.

Still referring to FIG. 7, the selection of the types of ions that are transmitted between electrodes that have a gradient of gas composition is controlled by a multitude of FAIMS operating parameters, including voltages such as DV and CV, physical geometry including width of the gap between the electrodes and the curvature of the electrodes (not shown in FIG. 7), and operational variables including the selection of the types of gases, temperature, temperature gradient, gas pressure, as some examples of the variables important to ion behavior in a FAIMS electrode.

Still referring to FIG. 7, an example of a non-limiting condition under which this effect occurs is discussed for illustrative purposes. In this example the type of ion and the type of gases is selected to illustrate the effect shown in FIG. 7, but is not selected to indicate that this is the only example to which this gradient of gas composition is applicable. It is known from the literature that the mobility of chloride anion increases in nitrogen whereas the mobility of this ion decreases in helium. If an asymmetric waveform with a negative polarity is applied to the first electrode 100 (electrode 101 at ground potential), and the electric fields at the peak of the waveform exceed about 50 Td, then a chloride anion is expected to migrate away from the first electrode 100 when the gas in the analyzer region 117 is nitrogen. This occurs because in nitrogen the mobility of chloride is higher when the first electrode is at the negative maximum voltage, than when the same electrode is at the maximum positive voltage during application of the asymmetric waveform (recall that DV is negative in this example). Under the same voltage conditions, but with helium gas in the analyzer region 117 the chloride anion drifts towards the first electrode 101. In this example, at a CV of zero volts, a gradient of gas composition having nitrogen near the first electrode 100 and helium near the second electrode 101, causes the chloride ion to behave in the manner discussed-above. When located near the first electrode 100 the chloride ion is contained in a gas primarily composed of nitrogen, and the chloride anion migrates away from the first electrode 100. When near the second electrode 101 the chloride ion is contained in a gas primarily composed of helium, and the chloride anion migrates away from the second electrode 101. When the gradient of gas composition is maintained along the ion pathway, the likelihood that the chloride anion will collide with one of the electrodes is decreased significantly. In this example, the ability of helium to diffuse is very high, and the mixture will gradually become uniform as the nitrogen and the helium form a mixture.

Still referring to FIG. 7, many other combinations of gases are expected to have a longer lifetime without complete mixing, than does nitrogen/helium. Mixing is less rapid using carbon dioxide as a first gas, and nitrogen as a second gas, as a further non-limiting example. Further optionally, the two gases discussed above are each a premixed gas prior to delivery to the FAIMS analyzer. It is known that certain mixtures of gases have very significant deviations from Blanc's law behavior and some ions therefore have very high CV's in these mixtures. As another non-limiting example, the first gas is a premixed binary combination of 50% nitrogen and 50% carbon dioxide, and the second gas is premixed binary combination of 5% sulfurhexafluoride and 95% carbon dioxide. In each case the first and second gases are selected to provide focusing of an ion of interest, at appropriate voltage and operating conditions, this focusing being promoted by the gradient in the composition of the gas in the analyzer region of FAIMS.

Figure 8:
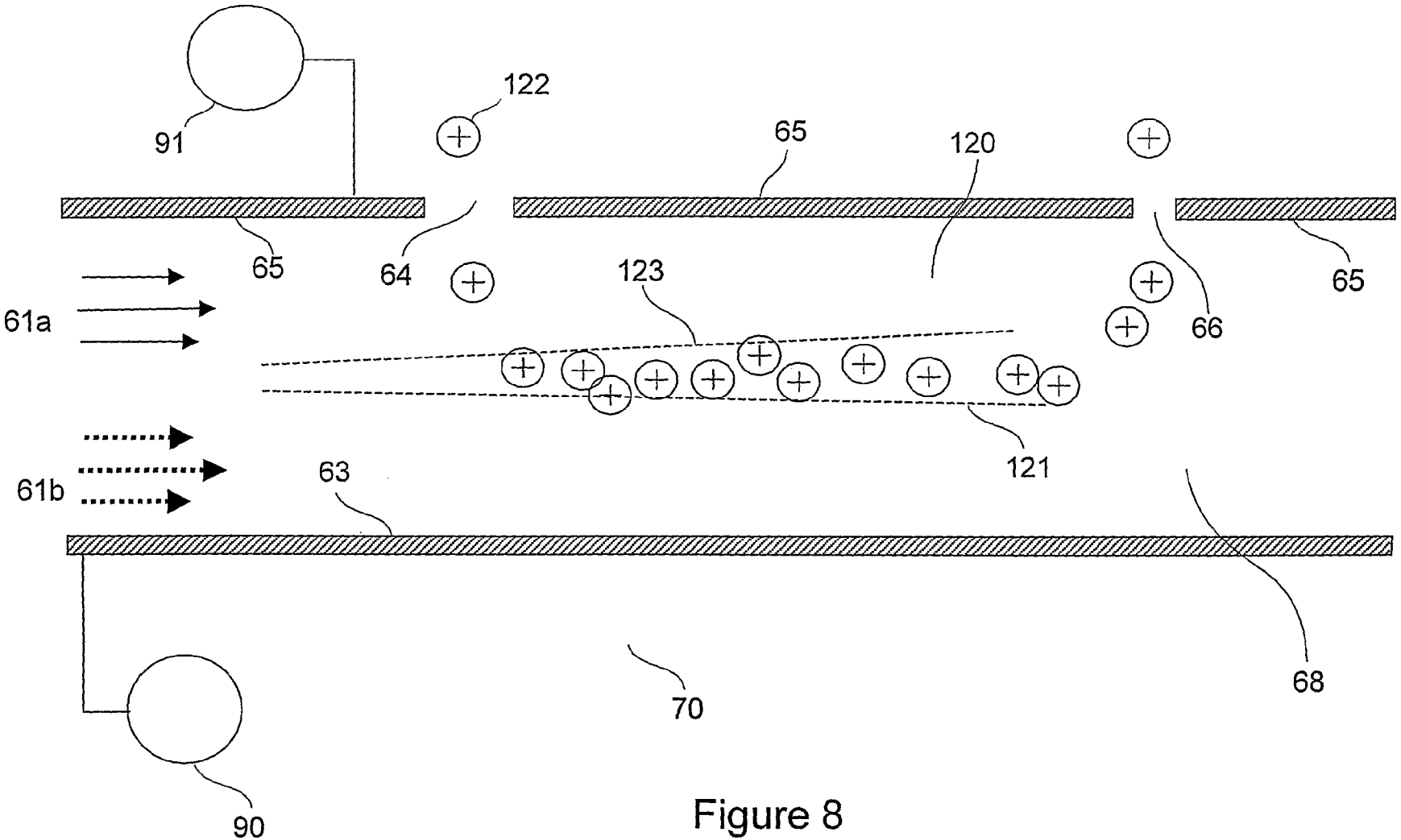
FIG. 8 illustrates the focusing of ions while being transported from an ion inlet to an ion outlet, in the presence of a gradient of gas composition between the FAIMS electrodes.

FIG. 8 illustrates the focusing of ions in a region within the analyzer region 68 between the upper electrode 65 and the lower electrode 63. Voltages are applied to the electrodes by power supplies 91 and 90 respectively. Ions 122 are introduced through ion inlet 64, preferably without introduction of a significant quantity of gas. Ions leave the analyzer through ion outlet 66. A gradient of gas composition is formed by a smooth flow of a first gas 61 a that is flowing parallel to, and at the same velocity as a flow of a second gas 61*b*. The diffusion of gases 61*a* and 61*b* into each other forms a gradient across the analyzer region 68. The ions 122 that pass into the analyzer region 68 are confined to a limited region indicated by the dashed lines 121 and 123. In some cases, the gradient in composition changes with time, and therefore in this illustration the dashed lines 121 and 123 are shown not to be parallel to each other.

Still referring to FIG. 8, other types of ions, having mobility properties unlike those of ion 122, are lost by collision with the electrodes 63 and 65. Some other ions, having mobility properties similar to those of the ion shown in FIG. 8, are also transmitted through the device, but may be focused at a location different than that between the lines 121 and 123 that are shown in FIG. 8. The gradient of gas composition cannot be maintained indefinitely because of mixing and diffusion. Furthermore, if the ions are carried out through the ion outlet 66 by the flow of gas, this gas composition gradient is modified in location and in gradient steepness as the gases approach the ion outlet 66. Some part of the flow of gas, or all of the flow of gas, in the analyzer is optionally used to carry the ions out through the ion outlet 66.

Figure 9:
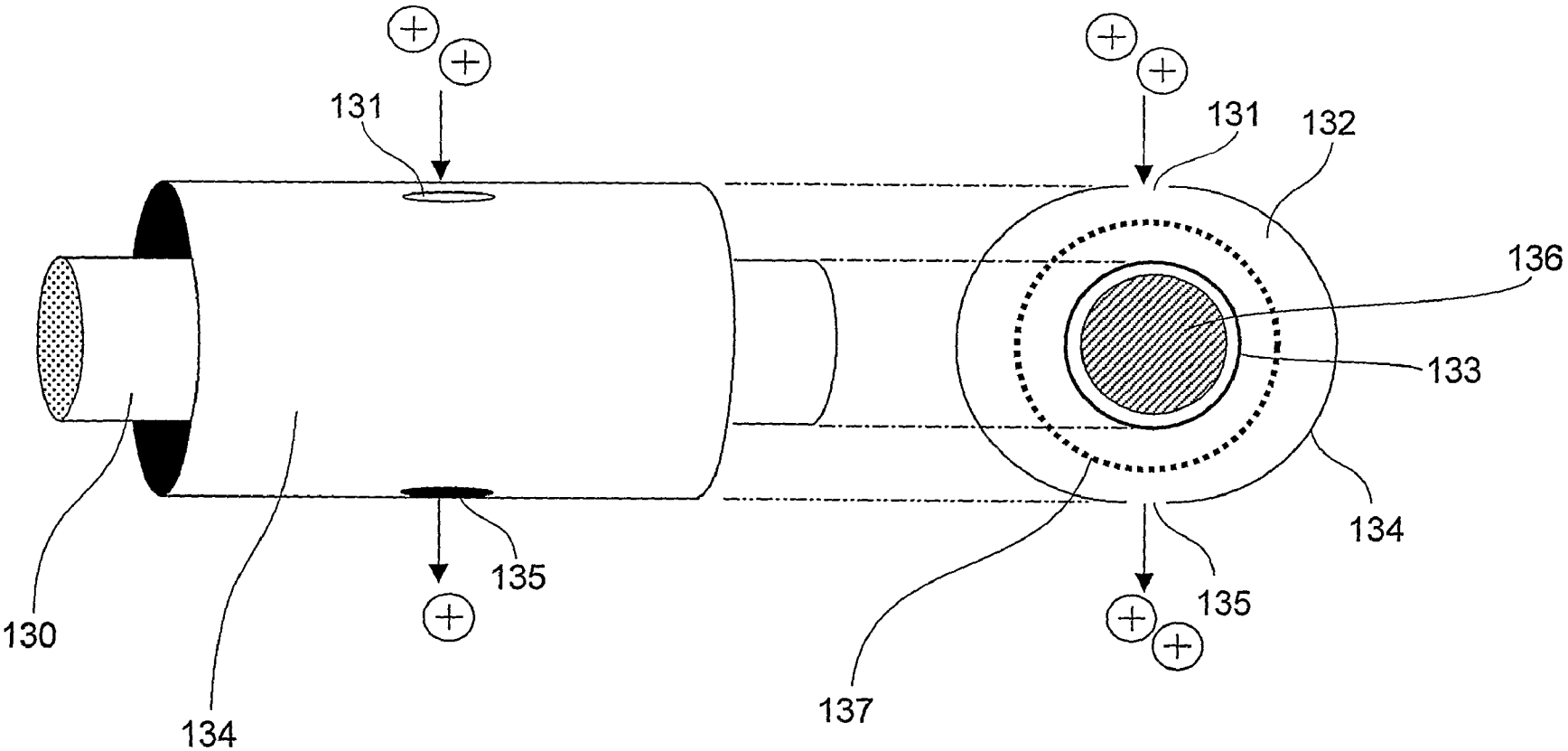
FIG. 9 is a cylindrical geometry side-to-side electrode, suitable for operation using a gradient in gas composition.

FIG. 9 illustrates a cylindrical geometry FAIMS of the side-to-side type, having an ion inlet 131 and an ion outlet 135. Gases are provided to the analyzer region 132 to form a gradient of composition across the analyzer region 132. In a first optional approach a first gas is provided through a first set of not illustrated holes in the outer electrode 134 and a second gas is provided through a second set of not illustrated holes in the inner electrode 130. In a second optional approach a first gas is provided through the ion inlet 131, and the second gas is provided through a set of not illustrated holes in the inner electrode 130. The gradient of gas composition in the analyzer region 132 results in focusing of the ions to a radial distance indicated by the dashed line 137, which is shown only for illustrative purposes. From the complex mixture that may be provided into the ion inlet 131, only those ions, whose mobility properties are appropriate at the voltage and operational parameters of FAIMS, are transmitted and these selected ions leave FAIMS through the ion outlet 135.

Figure 10:
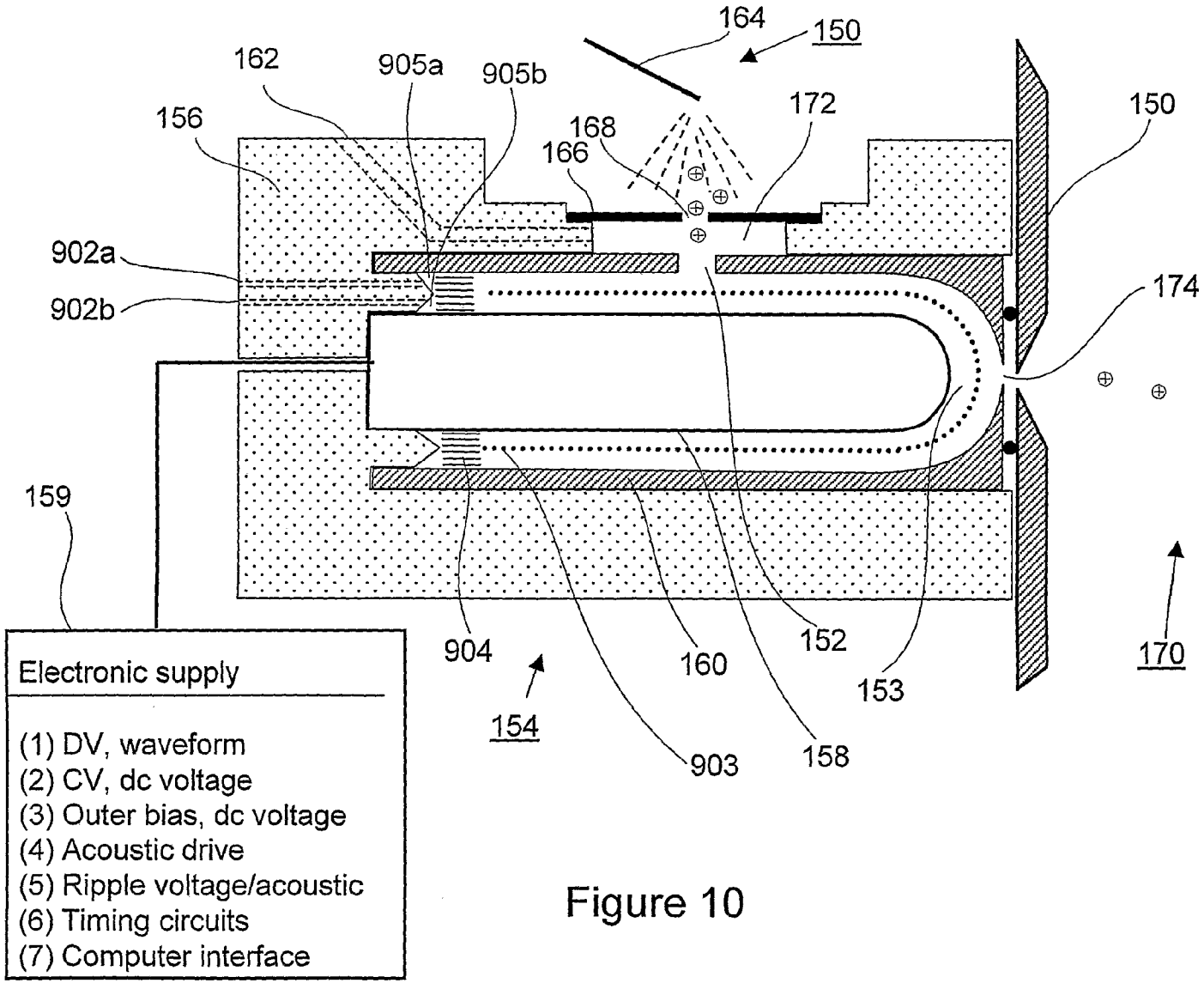
FIG. 10 is a cylindrical geometry FAIMS with a domed inner electrode, suitable for operation using a gradient in gas composition.

Referring now to FIG. 10, shown is a longitudinal cross-sectional view of an electrospray ion source 150 disposed in fluid communication with an ion inlet 152 of a FAIMS 154, the FAIMS 154 being mounted in and supported by an insulating material 156. According to FIG. 10, the inner electrode 158 and the outer electrode 160 are supported in a spaced-apart arrangement by an insulating material 156 with high dielectric strength to prevent electrical discharge. Some non-limiting examples of suitable materials for use as the insulating material 156 include Teflon™, and PEEK. A passageway 162 for introducing a curtain gas is shown by dashed lines in FIG. 10. Gas delivery ports 902*a* and 902*b* (shown as dashed lines) provide two gases of differing composition to the analyzer region 153 between the outer electrode 160 and the inner electrode 158. As a result of the gradient of gas composition, one or more ion focusing regions 903 surround the inner electrode 158, and assist in transmitting ions between the ion inlet 152 and the ion outlet 174.

Still referring to FIG. 10, a first gas and a second gas are provided through gas delivery ports 902*a* and 902*b*, respectively. The gases are distributed around the circumference of the inner electrode 158 by channels 905*a* and 905*b* behind a gas-flow directing element in the form of an array of plates 904, which ensures that the gases are flowing uniformly and parallel to the surfaces of the electrodes, so as to provide a stable and long-lived gradient of gas composition. The array of plates 904 comprises a plurality of axially aligned, cylindrical plate structures that are disposed in a radially spaced-apart arrangement. Stated differently, each cylindrical plate structure includes a convexly curved outer surface and a concavely curved inner surface that are joined by a first edge surface and by a second edge surface. The plurality of cylindrical plate structures are nested such that the convexly curved outer surface of each cylindrical plate structure faces the concavely curved inner surface of an adjacent cylindrical plate structure, so as to define a plurality of generally uniform annular gas-passage spaces in an alternating arrangement with the plurality of cylindrical plate structures. Furthermore, the plurality of cylindrical plate structures is disposed such that the first edge surface of some of the cylindrical plate structures is juxtaposed with gas delivery port 902*a*, and the first edge surface of other of the cylindrical plate structures is juxtaposed with gas delivery port 902*b*. The array of plates 904 directs the first gas to flow approximately parallel to, and adjacent to, the outer electrode 160. Similarly, the array of plates 904 directs the second gas to flow approximately parallel to, and adjacent to, the inner electrode 158. Preferably, the first gas and the second gas flow through the array of plates 904, traveling at approximately equal velocity, so as to minimize formation of turbulence and eddies in the gas flow.

In FIG. 10, the ions are formed near the tip of an electrospray needle 164 and drift towards a curtain plate 166. The curtain gas, introduced below the curtain plate 166 via the passageway 162, divides into two flows, the majority of which exits through an aperture 168 in the curtain plate 166, to prevent neutrals and droplets from entering the curtain plate aperture 168. Ions are driven against this gas by a voltage gradient between the needle 164 and the curtain plate 166. A field generated in the desolvation region 172 between the curtain plate 166 and the FAIMS outer electrode 160 pushes ions that pass through the aperture 168 in the curtain plate 166 towards the ion inlet 152 of FAIMS 154. A small portion of the curtain gas flows into the ion inlet 152. The gases forming the composition gradient carry the ions along the length of the FAIMS electrodes to the ion outlet 174, and into a mass spectrometer 170. Those ions with appropriate mobility properties are focused in the region indicated by the dashed line 903 and are transmitted, whereas other ions with different mobility properties collide with the electrodes are lost.

Figure 11:
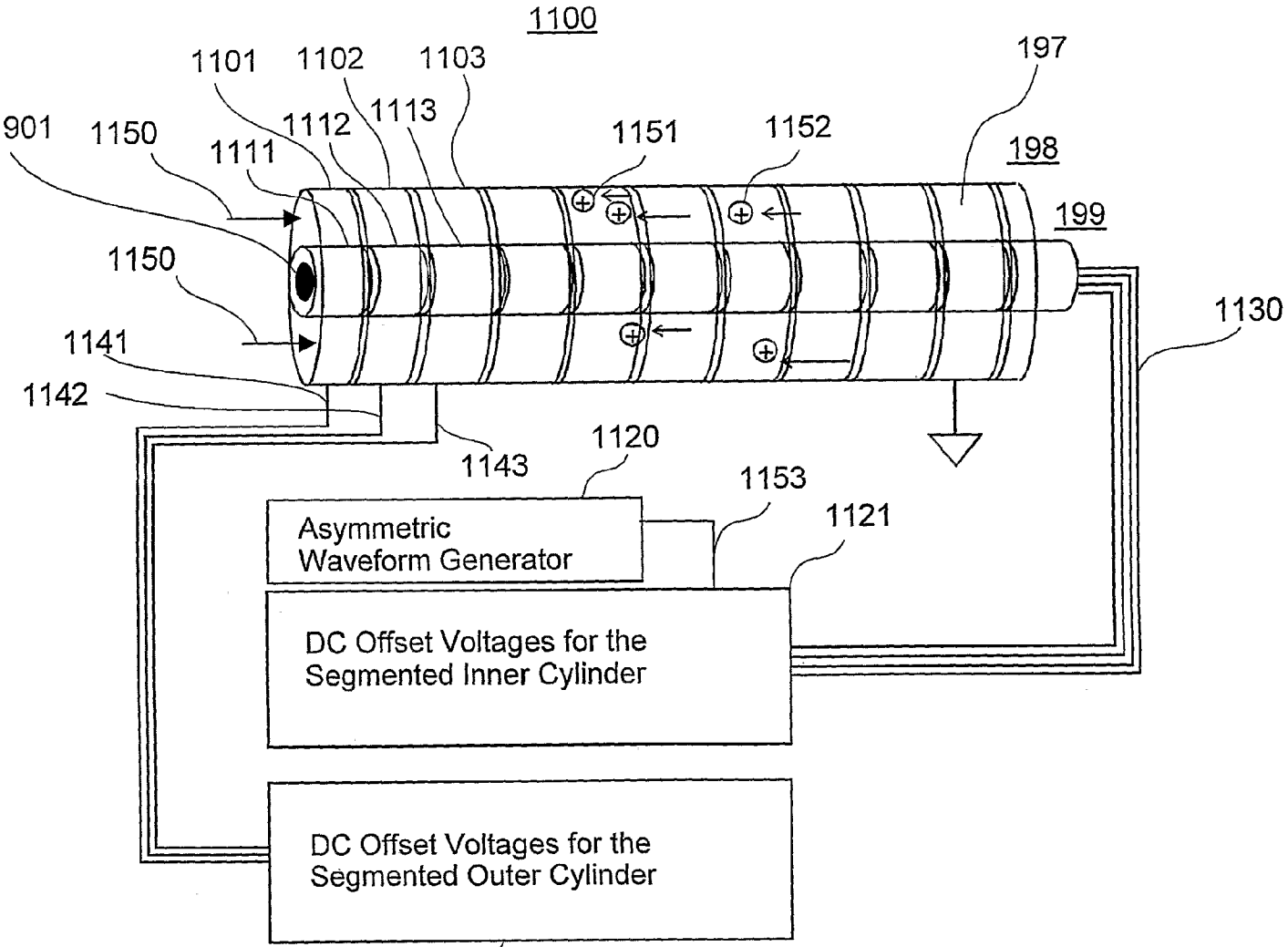
FIG. 11 is a segmented cylindrical FAIMS electrode suitable for operation using gradients of gas composition, which may be combined with longitudinal fields generated by voltages applied to the segments.

Referring now to FIG. 11, shown is a simplified view of a cylindrical segmented FAIMS 1100. The segmented inner electrode 199 is composed of a series of segments 1111, 1112, 1113 as well as further segments not enumerated, and the outer segmented electrode 198 is similarly subdivided into segments 1101, 1102, 1103 and further segments not enumerated. The inner segmented electrode 199 and the outer segmented electrode 198 are spaced apart by not-shown insulating support members. The segments comprising the segmented inner electrode 199 are electrically isolated from each other to permit application of independent voltages to each segment. Preferably the segments are close together, so it is expected that high voltage differences between the adjacent segments may cause electrical discharges between the segments. Preferably therefore, voltage differences between adjacent segments are low enough to avoid discharge.

Still referring to FIG. 11, the segments comprising the segmented inner electrode 199 and the segmented outer electrode 198 are spaced apart from each other by not-shown insulators. Preferably, the segments are closely spaced and the insulators separating the segments are not 'visible' to the ion flow. The collision of an ion with an insulating material produces an electric charge on the insulating material, because by definition the insulator cannot carry away the electricity. The electric charge is not controlled, and produces unpredictable electrostatic fields around the charged insulating surface. This means that preferably the not-shown insulator between segments 1111 and 1112 (and other similar pairs) is recessed below the outer surfaces of the segments 1111, 1112, 1113 and other segments that comprise the annular analyzer region 197. It is preferable that the ions 1151, 1152 and other ions that are flowing along the annular analyzer region 197 avoid collision with the not-shown insulation material that separates segments 1111 and 1112, and other similar pairs of segments, from each other. In this example the not-shown insulating material separating each pair of segments comprising both segmented inner electrode 199 and outer segmented electrode 198 is sufficiently below the surfaces of the segments that face into the analyzer region 197, that the electrostatic charge build up that might occur on the surfaces of the insulating material because of collisions with ions has minimum effect on the overall electric fields in the analyzer region 197.

Still referring to FIG. 11, a flow of gas 1150, shown as solid headed arrows flows in the annular analyzer region 197 between the segmented inner and outer electrodes 199 and 198, respectively. A not-shown ion source provides ions to the annular analyzer region 197, where the ions are caused to move by electric fields generated by application of voltages to the segments comprising the inner and outer segmented electrodes. In the example shown in FIG. 11 the ions 1151, 1152 and other ions not enumerated are transported by electric fields in a direction contrary to the flow of gas 1150. The voltages applied to consecutive segments is selected in this example to produce an electric field gradient that causes ions 1151, 1152 and other ions to be moved in the direction shown by the open headed arrows, while the gas 1150 flows in a direction shown by the closed headed arrows. Voltages are applied to the segments by electric power supplies 1120, 1121 and 1122. Connections to every segment of the inner segmented electrode 199 and outer segmented electrode 198 are not shown. The bundle of connections 1130 provides voltages from power supply 1121 to the segments 1111, 1112, 1113 and the other segments of the inner segmented electrode 199. In this example the voltage applied consists of a radio-frequency (rf) ac component added to a de voltage, where the rf component is equal in every segment, but the dc voltage may differ amongst the segments of the inner segmented electrode 199. Similarly a bundle of connectors 1141, 1142, 1143 and others not shown, provide voltages from outer bias power supply 1122 to the segments 1101, 1102, 1103 and other segments of the outer segmented electrode 198. In this example, the voltages applied to the outer segmented electrode 198 differ amongst the segments, and in this case rf voltage is not applied to any parts of the outer segmented electrode 198.

Still referring to FIG. 11, the rf voltage applied to the inner segmented electrode 199 is an asymmetric waveform produced by waveform generator voltage supply 1120 and delivered to power supply 1121 through connector 1153. The power supply 1121 provides a dc voltage offset, superimposed on the asymmetric waveform, to each segment of the segmented inner electrode 199, routed to each segment by an independent conductor comprising the bundle of connections 1130.

Still referring to FIG. 11, in use the series of segments are used to propel the ions along the length of the device, in a way that optionally is independent of the flow of gas, for example. Many optional arrangements of waveforms can be applied to the series of segments to capture the ions among certain segments, or to form a series of traveling waves. Advantageously, this device optionally is operated using a gradient in the composition of the gas in the analyzer region 197. The gradient in gas composition is optionally formed in a manner analogous to that shown in FIG. 10, each gas delivered to a region surrounding the circumference of the inner electrode 199. Optionally the gas is delivered to a region that is constrained by a gas diffuser that allows the gas to equilibrate at constant pressure at all circumferential locations, and therefore to flow out of the diffuser at constant flow rates at every circumferential location. The gas is then passed amongst an array of plates, as a non-limiting example, to further smooth the flow and to direct the gas flow to be parallel to the electrodes. In FIG. 11 the gas optionally flows in either direction along the analyzer, since the ions are propelled by the longitudinal fields generated by the segments of the electrodes.

Still referring to FIG. 11, the cloud of ions is constrained within certain radial locations by the gradient in gas composition, but simultaneously forced to move along the length of the device by control of the dc voltage offsets applied to the individual segment pairs, for example the pair of segments 1101 and 1111, the pair of segments 1102 and 1112, and so on throughout the device. In a non-limiting example the dc level of segments 1101 and 1111 is 10 volts, and the dc level of segments 1102 and 1112 is 9 volts, and the dc level of segments 1103 and 1113 is 8 volts, and so on along the electrodes. For example a sinusoidal voltage is applied to the inner electrodes to produce a 10 volt p-p superimposed on the dc level of each inner electrode. Continuing this example, the dc level of inner electrode 1111 is 10 volts, plus a sinusoidal wave that carries the voltage 5 volts more positive (up to +15 V) and 5 volts more negative (down to +5 V) than the dc value of 10 volts. Similarly, the dc level of inner electrode 1112 is 9 volts, now with an added a sinusoidal wave that carries the voltage 5 volts more positive (to +14 V) and 5 volts more negative (i.e. to +4 V) than the de value of 9 volts. Under these dc levels amongst the segments, a positive ion is caused to drift from right to left in FIG. 11. In this non-limiting example the series of segments are arranged to produce a uniform longitudinal drift along the annular tube. If a pulse of ions is introduced at the not illustrated inlet, the ions are separated in the manner of conventional drift tube ion mobility spectrometry, namely the highest mobility ions traversing the device more quickly than the lowest mobility ions. This device, because of the added benefit of the gradient in gas composition that helps to promote ion focusing, is characterized by very good ion transmission efficiency. This transmission efficiency beneficially increases ion focusing above that inherent in cylindrical geometry FAIMS, since FAIMS in cylindrical geometry also focuses the ions within limited radial locations in the annular region between the inner electrode 199 and the outer electrode 198.

Figure 12:
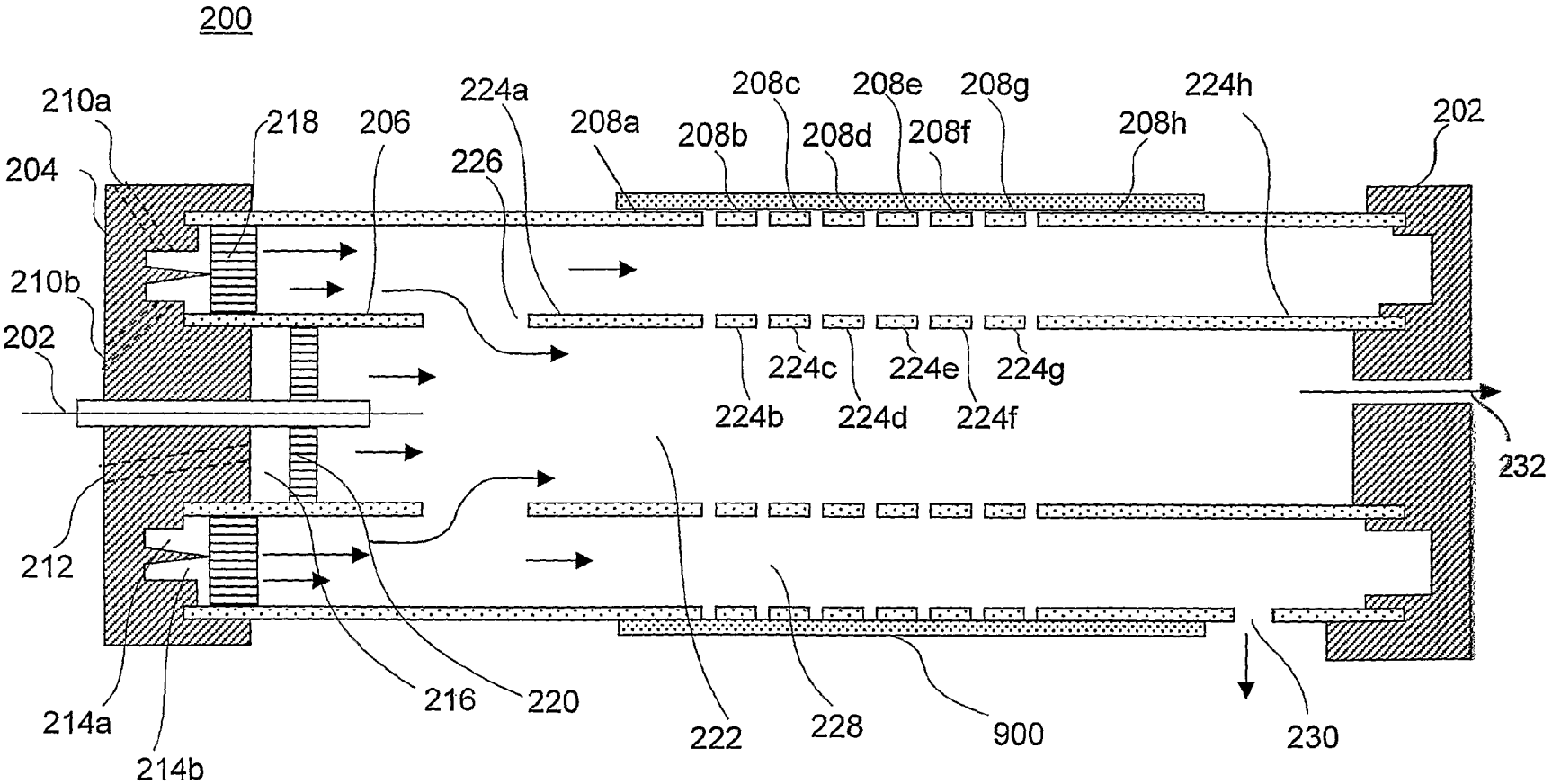
FIG. 12 is a segmented cylindrical FAIMS electrode system with internal ionization, suitable for operation with gradients in the gas composition, which can be combined with longitudinal fields generated by voltages applied to the segments.

FIG. 12 is a cylindrical geometry FAIMS 200, with a segmented inner electrode 224 including segments 224*a* to 224*h* and outer electrode 208 including segments 208*a* to 208*h*. Short segments 224*b* to 224*g* are spaced apart in a radial direction from similar length segments 208*b* to 208*g*, respectively. Ions are produced by ionizer 202, which optionally is one of an electrospray ionization source, a corona discharge ionization source, and an atmospheric pressure chemical ionization source as some non-limiting examples. The ionizer 202 is mounted in an insulating member 204 that also serves to support a short inner cylinder 206 and a long outer cylinder 208*a*. Flows of two types of carrier gases of differing composition pass through a pair of passageways 210*a* and 210*b* shown by dashed lines in insulating member 204. A flow of sampler gas flows through passageway 212 shown by dashed lines in insulating member 204. The carrier gases enter pressure equalization chambers 214*a* and 214*b*, and the sampler gas enters a separate equalization chamber 216. Diffusers 218 and 220 serve to restrict the carrier and sampler gases, respectively, and to allow these gases to flow uniformly around the circumference of the electrodes. The two types of carrier gas pass separately through the diffuser 218, and combine after the diffuser to flow in a smooth laminar flow along the annular space between the short inner cylinder 206 and the long outer cylinder 208*a*. Optionally, the two types of carrier gas is passed amongst an array of plates similar to the array of plates 904 described supra with reference to FIG. 10, as a non-limiting example, after the diffuser 218 to further smooth the flow and to direct the gas flow to be parallel to the electrodes. Similarly the sampler gas passes through the diffuser 220, and flows in a smooth laminar flow along the annular space between the ionizer 202 and the short inner cylinder 206. The sampler gas flows through the inner passage 222 within the inner electrode 224.

Still referring to FIG. 12, the ions produced by ionization source 202 are accelerated away from the source 202 in an outwardly radial direction by a voltage difference between the ionization source 202 and the short inner cylinder 206. Some ions pass through a gap 226 between the short inner cylinder 206 and the first segment of the inner cylinder 224*a*. Those ions that pass through the gap 226 may be entrained by the carrier gas and carried along the analyzer region 228, which is the annular space between the segmented inner cylinder 224 and the long segmented outer cylinder 208. The ions for which the gradient of gas composition, temperature, pressure, the applied waveform voltage and the compensation voltage are appropriate, pass along the analyzer region 228, and are carried by the carrier gas out of the FAIMS 200 through ion outlet 230. Optionally, the ions are analyzed further by mass spectrometry, or by other types of ion mobility spectrometers, further FAIMS devices etc., or are detected using ion detection technologies including amperometric or photometric as some non-limiting examples.

Still referring to FIG. 12 an asymmetric waveform and compensation voltage may be applied to the inner electrode 224. Bias voltages are applied to the short inner electrode 206 and the long outer electrode 208. The segments that comprise the inner electrode 224 and the long outer electrode 208 are at the same potential, or optionally are at potentials that permit measurement of the low-field mobility of the ions that are successfully transmitted at the asymmetric waveform voltage and the compensation voltage under the ambient conditions of gas composition (and gradient), gas pressure, and gas temperature.

Still referring to FIG. 12, it is preferable that a portion of the carrier gas that flows into the passageway 210 and through diffuser 218 enters the inner passage 222 within the inner electrode 224 by flowing radially inward through the gap 226. This inward flow of carrier gas helps to desolvate ions from ionization source 202 that are flowing outward through gap 226. This countercurrent of flowing gas helps to desolvate the ions and also prevents neutrals coming from the ionization source from entering the analyzer region 228. The neutrals produced from the sample, but not ionized by the ionizer 202, flow with the sampler gas along the inner passage 222 within the inner electrode 224 and out of sample outlet port 232. Preferably a not illustrated gas pump assists in pulling the sampler gas out of port 232, and assists in pulling a desolvating portion of carrier gas inward radially through the gap 226.

Still referring to FIG. 12, the number of segments of the inner electrode 224 and of the outer electrode 208 may be larger or fewer than shown in this figure. Further discussions assume that the electrodes are divided into a large number of segments. The cylindrical arrangement of the inner and outer coaxially arranged electrodes shown in FIGS. 11 and 12 give rise to an ion focusing in the annular analyzer region between the inner and outer electrodes, for an ion transmitted at the selected asymmetric waveform (DV) and the selected compensation voltage (CV), and for the particular gradients of gas composition and temperature that may be employed. This focusing helps to prevent ions from colliding with the inner and outer electrodes. The application of differing bias voltages on the segments of the segmented FAIMS shown in FIGS. 11 and 12 makes it possible to transport these ions along the length of the device. Ions are therefore selected on the basis of their high-field mobility behavior (to pass FAIMS at the selected DV and CV) as well as by their transport time through the device as selected by appropriate voltages and arrangements of voltages applied to the segments of the inner and outer electrodes.

Figure 13:
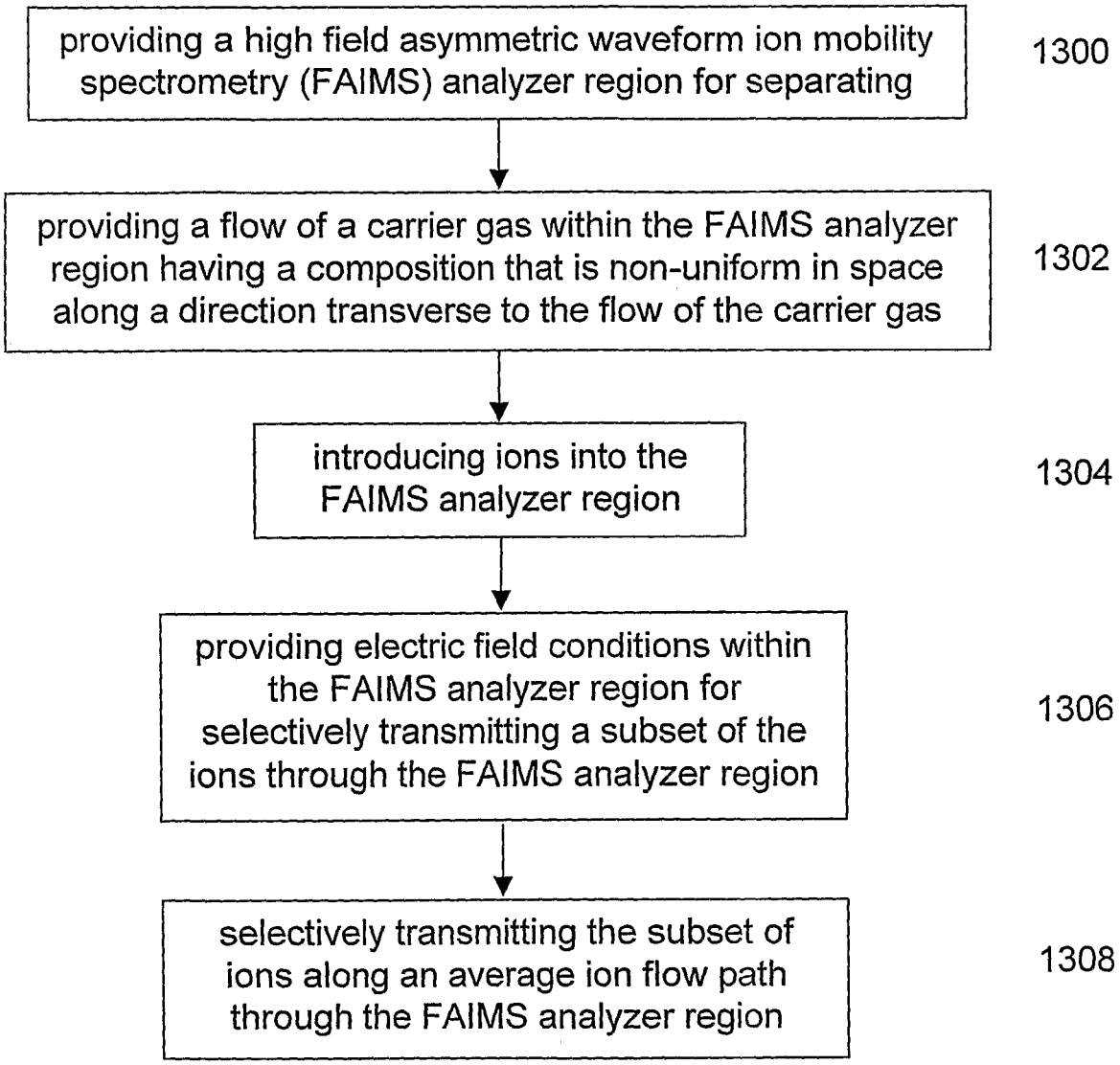
FIG. 13 is a simplified flow diagram of a method of separating ions according to an embodiment of the instant invention; and, FIG. 14 is a simplified flow diagram of another method of separating ions according to an embodiment of the instant invention.

Referring now to FIG. 13, shown is a simplified flow diagram of a method of separating ions according to an embodiment of the instant invention. At step 1300 a high field asymmetric waveform ion mobility spectrometry (FAIMS) analyzer region is provided for separating ions. At step 1302 a flow of a carrier gas is provided within a portion of the FAIMS analyzer region. The flow of carrier gas has a composition that is non-uniform in space along a direction transverse to the flow of the carrier gas. At step 1304 ions are introduced into the FAIMS analyzer region. At step 1306 electric field conditions are provided within the FAIMS analyzer region for selectively transmitting a subset of the ions through the FAIMS analyzer region. At step 1308 the subset of ions is selectively transmitting along an average ion flow path through the FAIMS analyzer region.

Figure 14:
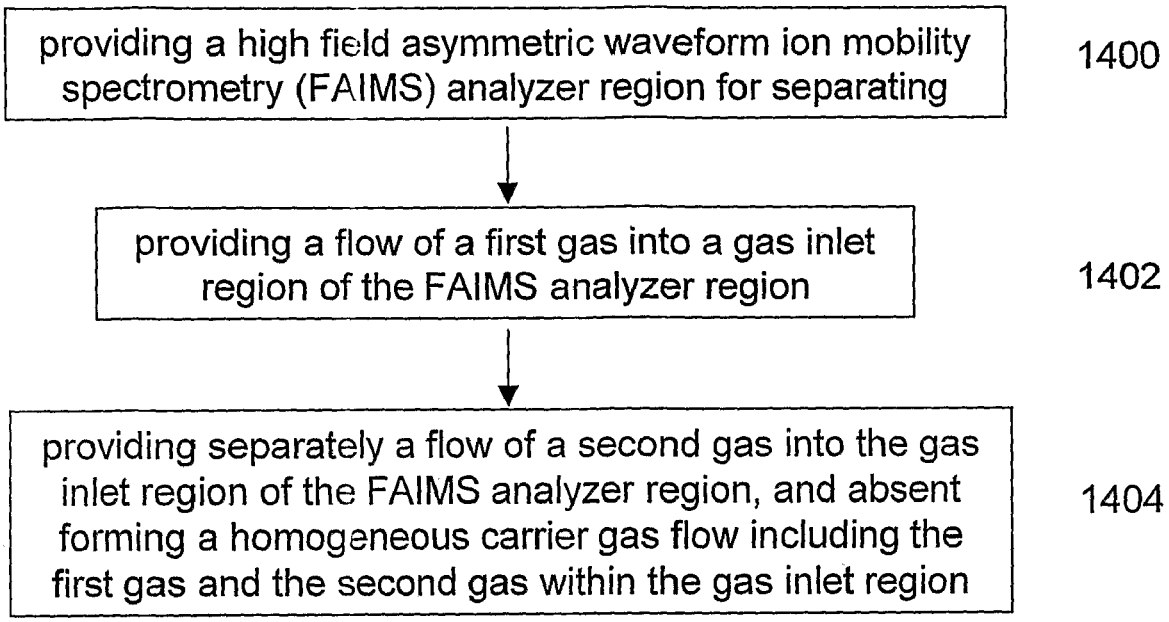

Referring now to FIG. 14, shown is a simplified flow diagram of another method of separating ions according to an embodiment of the instant invention. At step 1400 a high field asymmetric waveform ion mobility spectrometry (FAIMS) analyzer region is provided for separating ions. In particular, the FAIMS analyzer region comprising an ion origin end that is in fluid communication with an ionization source, and an ion exit end that is in fluid communication with an ion detecting device, a length of the FAIMS analyzer region defined along a direction between the ion origin end and the ion detection end. At step 1402 a flow of a first gas is provided into a gas inlet region of the FAIMS analyzer region. At step 1404 a flow of a second gas is provided separately into the gas inlet region of the FAIMS analyzer region. In particular, the flow of the second gas is provided absent forming a homogeneous carrier gas flow including the first gas and the second gas within the gas inlet region.

Numerous other embodiments may be envisaged without departing from the spirit and scope of the invention.

What is claimed is:

1. An apparatus for separating ions, comprising:

a first electrode and a second electrode disposed one relative to the other in a spaced-apart facing arrangement for defining an analyzer region therebetween, the analyzer region including a first end and a second end and having a length extending between the first end and the second end;

a first gas inlet in fluid communication with the analyzer region, for providing a flow of a carrier gas of a first composition;

a second gas inlet in fluid communication with the analyzer region, for providing a flow of a carrier gas of a second composition; and, a gas-flow directing element in fluid communication with the first gas inlet and in fluid communication with the second gas inlet, for receiving the flow of the carrier gas of the first composition and the flow of the carrier gas of the second composition, and for providing within a portion of the analyzer region a carrier gas flow having a composition that is non-uniform in space.

2. An apparatus according to claim 1, wherein during use the carrier gas flow within the portion of the analyzer region has substantially the first composition adjacent the first electrode and substantially the second composition adjacent the second electrode.

3. An apparatus according to claim 2, wherein during use the composition of the carrier gas flow varies across the analyzer region between the first electrode and the second electrode along a direction transverse to the length.

4. An apparatus according to claim 1, wherein the gas-flow directing element comprises a plurality of plate structures that are disposed in a stacked, spaced-apart arrangement.

5. An apparatus according to claim 1, wherein the first electrode and the second electrode each comprise a flat-plate electrode body.

6. An apparatus according to claim 1, wherein the gas-flow directing element comprises a diffuser that is disposed for restricting the flow of the carrier gas of the first composition and for restricting the flow of the carrier gas of the second composition.

7. An apparatus according to claim 1, comprising an electrical contact on one of the first electrode and the second electrode for receiving an electrical signal from a power supply for applying an asymmetric waveform voltage to the one of the first electrode and the second electrode, and for providing a direct current voltage difference between the first electrode and the second electrode.

8. An apparatus according to claim 1, wherein the analyzer region is a high field asymmetric waveform ion mobility spectrometry (FAIMS) analyzer region.

9. An apparatus according to claim 1, wherein the gas-flow directing element comprises a plurality of axially aligned, cylindrical plate structures that are disposed in a radially spaced-apart arrangement.

10. A method of separating ions, comprising:

providing a high field asymmetric waveform ion mobility spectrometry (FANS) analyzer region for separating ions;

providing a flow of a carrier gas within a portion of the FAIMS analyzer region, the flow of carrier gas having a composition that is non-uniform in space along a direction transverse to the flow of the carrier gas;

introducing ions into the FAIMS analyzer region;

providing electric field conditions within the FAIMS analyzer region for selectively transmitting a subset of the ions through the FAIMS analyzer region; and, selectively transmitting the subset of ions along an average ion flow path through the FAIMS analyzer region.

11. A method according to claim 10, wherein providing a flow of carrier gas within a portion of the FAIMS analyzer region comprises providing a flow of a first gas and providing separately a flow of a second gas.

12. A method according to claim 11, wherein a composition of the flow of the first gas is different than a composition of the flow of the second gas.

13. A method according to claim 11, wherein providing a FAIMS analyzer region for separating ions comprises providing a first electrode surface and a second electrode surface that is spaced-apart from the first electrode surface and facing the first electrode surface, the first electrode surface substantially parallel to the second electrode surface.

14. A method according to claim 13, wherein providing a flow of the first gas comprises directing the first gas to flow adjacent and substantially parallel to the first electrode surface.

15. A method according to claim 14, wherein providing a flow of the second gas comprises directing the second gas to flow adjacent and substantially parallel to the second electrode surface.

16. A method according to claim 15, comprising directing the first gas flow and directing the second gas flow absent forming a carrier gas flow having a homogeneous composition.

17. A method according to claim 15, comprising directing the first gas flow and directing the second gas flow absent substantial mixing between the first gas flow and the second gas flow within the portion of the FAIMS analyzer region.

18. A method according to claim 15, comprising providing a gas flow directing element for affecting the first gas flow and the second gas flow prior to introduction into the portion of the analyzer region.

19. A method according to claim 15, comprising providing a gas flow directing element for providing substantially laminar flow of the first gas adjacent the first electrode surface and for providing substantially laminar flow of the second gas adjacent the second electrode surface.

20. A method according to claim 14, comprising providing a diffuser that is disposed between a gas source region and the portion of the analyzer region for restricting the flow of the first gas and for restricting the flow of the second gas.

21. A method according to claim 14, comprising disposing a diffuser between a gas source region and the portion of the analyzer region for equilibrating a pressure of the first gas and equilibrating a pressure of the second gas prior to introduction into the portion of the analyzer region.

22. A method according to claim 11, wherein the carrier gas composition that is non-uniform in space comprises a composition gradient extending between a portion that is enriched in the first gas proximate the first electrode surface and a portion that is enriched in the second gas proximate the second electrode surface.

23. A method according to claim 22, wherein a volume fraction of the first gas in the carrier gas decreases with increasing separation from the first electrode surface.

24. A method according to claim 10, wherein at least one of the flow of the first gas and the flow of the second gas is a flow of a single component gas.

25. A method according to claim 10, wherein at least one of the flow of the first gas and the flow of the second gas is a flow of a mixed gas.

26. A method according to claim 10, wherein selectively transmitting the subset of ions along an average ion flow path through the analyzer region comprises entraining the subset of ions in the flow of a carrier gas.

27. A method according to claim 10, wherein selectively transmitting the subset of ions along an average ion flow path through the analyzer region comprises providing an electric field gradient directed along a direction opposite the flow of carrier gas for causing the subset of ions to drift along the direction opposite the flow of carrier gas.

* * * * *